US011434748B2

(12) United States Patent
Hird et al.

(10) Patent No.: US 11,434,748 B2
(45) Date of Patent: Sep. 6, 2022

(54) INSTRUMENTED ROTARY TOOL WITH SENSOR IN CAVITY

(71) Applicant: Schlumberger Technology Corporation, Sugar Land, TX (US)

(72) Inventors: Jonathan Robert Hird, Dry Drayton (GB); Ashley Bernard Johnson, Cambridge (GB); Michael Paul Barrett, Histon (GB); Walter David Aldred, Thriplow (GB); Tomas Rosinski, Cramlington (GB); Jarek Rosinski, Cramlington (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 9 days.

(21) Appl. No.: 16/833,719

(22) Filed: Mar. 30, 2020

(65) Prior Publication Data

US 2020/0308954 A1 Oct. 1, 2020

Related U.S. Application Data

(60) Provisional application No. 62/827,373, filed on Apr. 1, 2019.

(51) Int. Cl.
*E21B 47/013* (2012.01)
*E21B 47/024* (2006.01)
(Continued)

(52) U.S. Cl.
CPC ..... *E21B 47/013* (2020.05); *E21B 47/007* (2020.05); *E21B 47/01* (2013.01); *E21B 47/017* (2020.05); *E21B 47/024* (2013.01); *E21B 47/07* (2020.05); *E21B 47/12* (2013.01); *E21B 10/42* (2013.01)

(58) Field of Classification Search
CPC ..... E21B 10/00; E21B 47/00; E21B 47/01; E21B 47/013; E21B 47/017; E21B 47/024; E21B 47/12
See application file for complete search history.

(56) References Cited

U.S. PATENT DOCUMENTS 5,113,953 A 5/1992 Noble
5,309,260 A 5/1994 Mizrahi et al.
(Continued)

FOREIGN PATENT DOCUMENTS

WO 2020205460 A1 10/2020

*Primary Examiner* — Tara Schimpf

(57) ABSTRACT

A rotary tool for operation within an underground borehole or within tubing in a borehole has a tool body and at least one sensor-containing unit attached to the tool body and positioned to contact the conduit wall. The sensor-containing unit includes an exterior portion to contact the borehole or tubing wall and one or more sensors is located in a cavity between the exterior portion and the tool body. The sensor-containing unit may be formed from the exterior portion, an attachment portion for attachment to the tool body, and one or more connecting portions extending between the attachment and exterior portions, with the sensor-containing cavity between the attachment and exterior portions. Possible rotary tools include drill bits, reamers, mills, stabilizers, and rotary steerable systems.

20 Claims, 16 Drawing Sheets

(51) Int. Cl.

| | |
|---|---|
| ***E21B 47/007*** | (2012.01) |
| ***E21B 47/12*** | (2012.01) |
| ***E21B 47/07*** | (2012.01) |
| ***E21B 47/017*** | (2012.01) |
| ***E21B 47/01*** | (2012.01) |
| *E21B 10/42* | (2006.01) |

(56) References Cited

U.S. PATENT DOCUMENTS

| | | | | |
|---|---|---|---|---|
| 5,502,255 | A | 3/1996 | Keana et al. | |
| 5,706,905 | A | 1/1998 | Barr | |
| 5,956,442 | A | 9/1999 | Byron | |
| 5,971,085 | A | 10/1999 | Colebrook | |
| 6,089,332 | A | 7/2000 | Barr et al. | |
| 6,092,610 | A | 7/2000 | Kosmala et al. | |
| 6,158,529 | A | 12/2000 | Dorel | |
| 6,244,361 | B1 | 6/2001 | Comeau et al. | |
| 6,364,034 | B1 | 4/2002 | Schoeffler | |
| 6,732,817 | B2 | 5/2004 | Dewey et al. | |
| 6,957,708 | B2 * | 10/2005 | Chemali | E21B 47/002 175/50 |
| 7,188,685 | B2 | 3/2007 | Downton et al. | |
| 7,954,564 | B2 | 6/2011 | Makkar et al. | |
| 8,672,056 | B2 | 3/2014 | Clark et al. | |
| 10,353,111 | B2 * | 7/2019 | Sanstrom | G01V 11/00 |
| 2001/0052428 | A1 | 12/2001 | Larronde et al. | |
| 2006/0065395 | A1 * | 3/2006 | Snell | E21B 41/0078 166/255.2 |
| 2014/0262513 | A1 * | 9/2014 | Chau | E21B 47/017 175/40 |
| 2017/0199295 | A1 * | 7/2017 | Mandal | E21B 47/085 |
| 2018/0252090 | A1 * | 9/2018 | Borg-Bartolo | G01M 5/0058 |
| 2019/0055833 | A1 * | 2/2019 | Jaaskelainen | E21B 47/01 |
| 2019/0249548 | A1 * | 8/2019 | Zhang | E21B 47/017 |
| 2020/0308955 | A1 | 10/2020 | Hird et al. | |

* cited by examiner

INSTRUMENTED ROTARY TOOL WITH SENSOR IN CAVITY

CROSS-REFERENCE TO RELATED APPLICATIONS

This application claims the benefit of, and priority to, U.S. patent application Ser. No. 62/827,373, filed Apr. 1, 2019. This application is also related to U.S. patent application Ser. No. 62/827,516 filed Apr. 1, 2019 and to U.S. patent application Ser. No. 62/827,549, filed Apr. 1, 2019. Each of the foregoing is expressly incorporated herein by this reference in its entirety.

BACKGROUND

When rotary tools are used in a wellbore, some such tools may contact the wall of the wellbore. This contact may serve to drill, enlarge, or position the tool in the wellbore, or to act as a contact point for steering a wellbore in a particular direction. FIG. 2 illustrates an example fixed cutter drill bit fitted with cutters for drilling through formations of rock to form a wellbore. This drill bit has a main body which is rigidly connected to a shank terminating in a threaded connection 5 for connecting the drill bit to a drill string (not shown in FIG. 2) that is employed to rotate the bit in order to drill the wellbore. Blades 6 carry cutters 8 that project from the body of the drill bit and which are separated by channels 9 (e.g., fluid courses or junk slots) for flow of drilling fluid supplied down the drill string and delivered through nozzles or other apertures in the drill bit. At the outer end of each blade 6 there is a region 7—referred to as a gauge pad—that reflects the maximum radial distance of the blade 6 from the longitudinal axis of the bit. The gauge pad surface may form part of a cylinder centered on the rotational axis of the drill bit and having the radius equal to that cut by the outermost cutters. These gauge pads 7 are thus able and intended to slide on the wall of the wellbore as it is drilled, thereby positioning the drill bit in the wellbore. In practice the drill bit and gauge pads are subject to vibration and so the pads may make intermittent, rather than continuous, sliding contact with the wellbore wall.

FIG. 3 is a perspective view of a cutter block of an expandable reamer. This block is one three blocks that may selectively expand from positions distributed azimuthally around the main body of the reamer. Expansion of these blocks is guided by splines 14 which engage grooves in the main body of the reamer. This cutter block has upper and lower cutting regions 10, 12 carrying cutters 8, and a middle section 11 which includes a gauge pad 13. This gauge pad has a generally smooth outward facing surface at the radius cut by the outermost cutters so as to slide on the wellbore wall which has been enlarged by the cutters of one or more of the cutting regions 10, 12.

SUMMARY

This summary is provided to introduce a selection of concepts that are further elaborated below in the detailed description. This summary is not intended to be used as an aid in limiting the scope of the claimed subject matter.

Embodiments of the present disclosure include a rotary tool in which one or more sensors are located in a cavity which is inwardly from and shielded by an exterior portion on the tool, which portion contacts the wall of a conduit in which the tool is operated. An aspect of the present disclosure provides a rotary tool for operation within an underground conduit, wherein the tool has a body rotatable around an axis of the tool, and at least one exterior portion which is carried by the tool body and which is positioned radially outwardly from the tool body for contact with the wall of the conduit, wherein at least one sensor is located in a cavity between the exterior portion and the tool body.

The exterior portion may be positioned for contact with the wall of a conduit and is optionally attached to the tool body through one or more connecting portions having a total cross-sectional area facing towards the conduit wall that is less than the area of the exterior portion which faces radially outwards towards the wall of the conduit.

The exterior portion may be configured for sliding contact with the conduit wall and may have a smooth outer surface for this reason. However, the exterior portion may possibly include cutters to remove material from the conduit wall, or may have a rough outer surface intended to abrade some material from the conduit wall.

In the same or other embodiments, a connecting portion is more compliant than the exterior portion of a sensor-containing unit so as to show greater distortion than the exterior portion when contact with the conduit wall applies force to the exterior portion. This increased compliance can facilitate observation of force by giving a larger dimensional distortion to observe. A connecting portion may be more compliant than the exterior portion because it differs from the exterior portion in one or more of dimensions, material, heat treatment, or the like. In some constructional forms, the cross-sectional area of a connecting portion, or the combined cross-sectional area of a plurality of connecting portions through which the exterior portion is attached, may be less than the exterior portion's surface area configured to face and contact the conduit wall.

Distortion within a sensor-containing unit caused by force on the exterior portion can also be referred to as strain caused by stress (i.e. generated from a force) on the exterior portion. A sensor-containing unit may be designed and dimensioned with an intention that distortion during use will remain within the elastic limits of constructional materials and so will be no more than reversible, elastic strain. However, a sensor may have ability to observe and be responsive to distortion which exceeds an elastic limit.

An exterior portion positioned for contact with the wall of a conduit may be a part of a sensor-containing unit that is attached to a rotary tool and can include the exterior portion itself, an attachment portion attached to a tool body of the rotary tool, and one or more connecting portions which join the exterior portion to the attachment portion. The cavity which accommodates at least one sensor may be located between the exterior portion and the attachment portion.

Free space around sensors within the cavity may be filled (e.g., with an electrically insulating material) to restrict or prevent drilling fluid or other liquid found in the underground conduit from entering the cavity. Additionally, or alternatively, the cavity may be surrounded by a shield extending over at least part of the distance between the exterior portion and the tool body. Where the exterior portion is part of a unit with an attachment portion, the cavity may be surrounded by a shield extending over at least part of the distance between the exterior portion and the attachment portion.

An exterior portion facing outwardly towards the wall of the conduit is optionally longer (e.g., measured axially) than they are wide (e.g., measured in a circumferential direction). A cavity accommodating at least one sensor may extend radially for a distance less than the length and width of the cavity. The axial length of the cavity may be greater than the circumferential width.

Sensors which may be accommodated within a cavity are of various types, including accelerometers, magnetometers, inclinometers, temperature sensors, and strain gauges. Such sensors may be used to enable or assist navigation of a steerable tool, to monitor the motion and vibration of a tool as it rotates, or to measure forces on the exterior portions as they contact the conduit wall.

In a further aspect this disclosure provides a method of obtaining data by operating a rotary tool as any set forth herein and observing or recording data from the sensor(s) while operating the tool. The method may include operating a rotary drill string within a conduit by incorporating at least one rotary tool as described herein into the drill string and observing or recording data from a sensor or sensors of a tool as stated herein.

DETAILED DESCRIPTION

Embodiments of the present disclosure relate to providing instrumentation in a rotary tool for operation in an underground conduit. Possible types of conduits include wellbores that extend into geological formations from the Earth's surface (where surface may be ground level at which the ground meets atmosphere or may be the seabed at which ground meets water). When a wellbore is drilled, at least part of the wellbore may be lined with casing or liner and the present disclosure includes rotary tools for operation within cased/lined wellbores as well as within fully or partially openhole wellbores.

Sensors or other instrumentation may observe operation of the tool and/or assist steering of a steerable tool. Examples of sensors for these purposes include accelerometers and magnetometers. Other sensors may observe conditions within the conduit such as temperature. One challenge when designing a rotary tool equipped with sensors is to identify locations where sensors can be accommodated and protected from the environment within the underground conduit.

A rotary tool of the present disclosure may be attached to the downhole end of a drill string and rotated within the conduit by a downhole motor, or in more traditional manner may be driven from the surface along with the rest of the drill string. As mentioned, an example of tool at the downhole end is a drill bit with gauge pads to contact the newly drilled borehole wall, although other rotary tools are also contemplated, as discussed herein.

Figure 1:
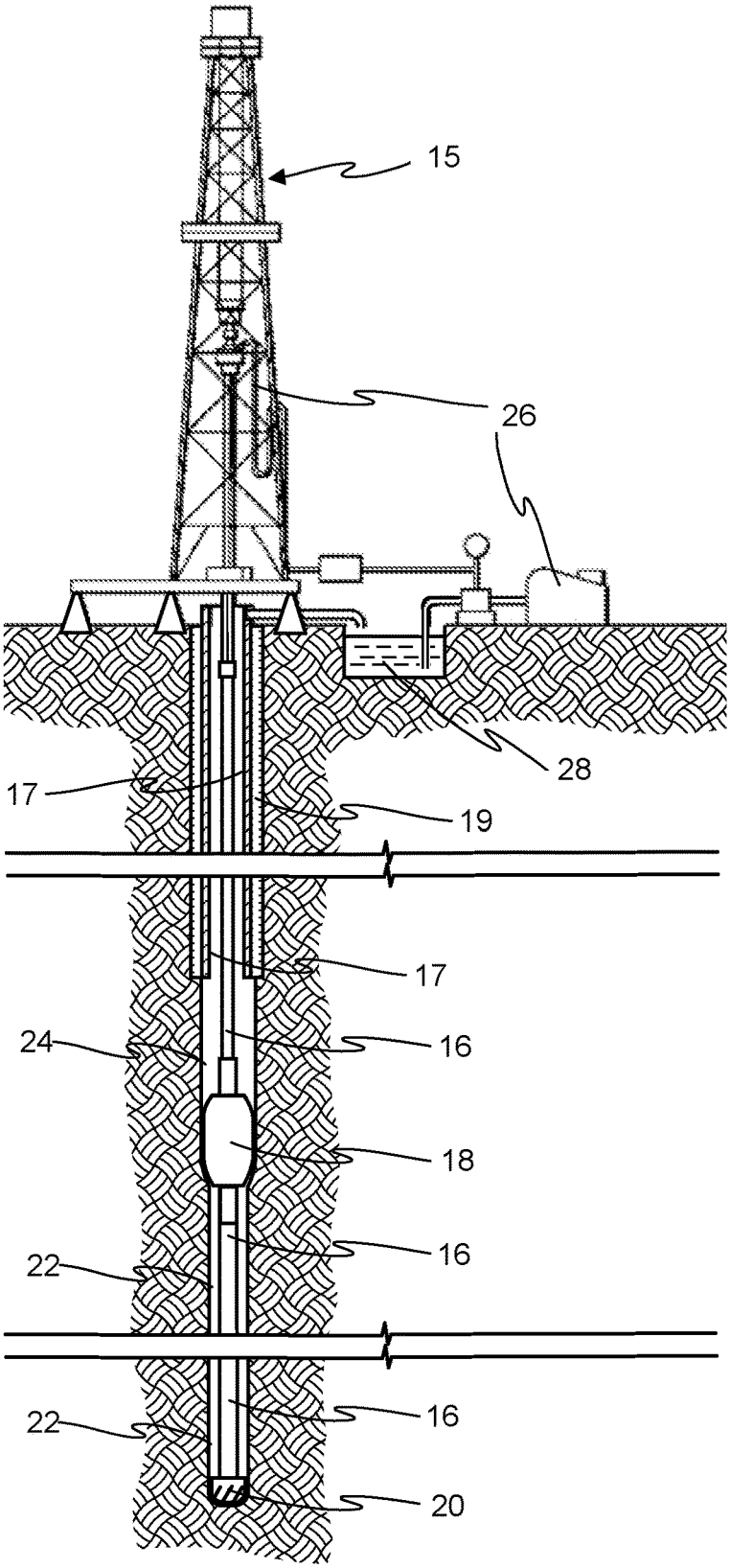
FIG. 1 (prior art)
FIG. 1 is a schematic, partial cross-sectional view of a drilling assembly in a borehole.

Drilling a wellbore is illustrated by FIG. 1 which shows by way of example a drilling assembly of a known type. This includes both a drill bit 20 and an expandable underreamer 18. A drill string 16 extends from a drilling rig 15 into a wellbore. An upper part of the wellbore has already been lined with casing 17 and cemented as indicated at 19. The drill string 16 is connected to an underreamer 18 which is connected by more of the drill string 16 to the drill bit 20. The underreamer 18 has been expanded below the cased section of the wellbore. As the drill string 16 is rotated and moved downwardly in the wellbore, the drill bit 20 extends a pilot hole 22 downwards while the underreamer 18 opens the pilot hole 22 to a larger diameter wellbore 24.

The drilling rig 15 is provided with a system 26 for pumping drilling fluid from a supply 28 down the drill string 16 to the underreamer 18 and the drill bit 20. Some of this drilling fluid optionally flows through ports or other passages in the underreamer 18, into the annulus around the drill string 16, and back up the annulus to the surface. Additional quantities of drilling fluid flow through the interior of the reamer and downwardly in the bottomhole assembly (BHA) to the drill bit 20, where the fluid flows out through nozzles or ports, into the annulus around the drill string 12, and back to the surface. The distance between the underreamer 18 and the drill bit 20 at the foot of the bottom hole assembly is fixed so that the pilot hole 22 and the enlarged wellbore 24 are simultaneously extended downwardly.

It will of course be understood that it would be possible to drill without the underreamer 18 present, so that the wellbore is drilled at the diameter of the drill bit 20. It would also be possible to use the same underreamer 18 attached to drill string 16, although without the drill bit 20 and the part of the drill string 16 shown below the underreamer 18 in FIG. 1, in order to enlarge a wellbore which had been drilled previously. Additionally, although the underreamer 18 and drill bit 20 are described as being connected by drill string 16, it will be appreciated that the underreamer 18 and drill bit 20 may be part of a BHA that includes drill collars, sensor tools (e.g., MWD, LWD tools), jars, heavy weight drill pipe, bypass valves, disconnect subs, or other components, rather than the same drill pipe making up the drill string 16 above the upper end of the underreamer 18.

Various aspects of the present disclosure may be embodied in a rotary tool attached to the downhole end of a drill string which extends into a wellbore from the surface as illustrated by FIG. 1. The tool may be attached to the drill string by a connector on the tool or may be within a BHA. The tool may be rotated within the conduit by a downhole motor, or in more traditional manner may be driven from the surface along with the rest of the drill string. As already mentioned, an example of tool at or near the downhole end of a drill string is a drill bit with gauge pads to contact the newly drilled wellbore wall.

The concepts of the present disclosure may also be embodied in a rotary tool incorporated into a drill string or BHA at an intermediate position between, and spaced from, the uphole and downhole ends of the drill string. Tools employed at such intermediate positions include reamers (e.g., underreamers, hole openers, etc.) as shown by FIG. 1 which enlarge a wellbore and also stabilizers which contact the wellbore wall to assist in positioning the drill string in a wellbore, section or casing mills that remove sections of installed casing, pipe cutters that cut through casing, and the like. A tool employed at an intermediate position may incorporate two connectors for attachment to the drill string above and below the tool, or may include a single connector for attachment to the drill string above the tool.

Another possibility is that a tool within the present disclosure is attached to coiled tubing which is inserted into a wellbore from the surface. The tool may be driven by a downhole motor at the downhole end of the coiled tubing, and optionally conveyed by a tractor used to convey the tool into a wellbore.

Embodiments of the present disclosure will first be illustrated by an embodiment which is a drill bit equipped with sensor-containing units which provide one or more gauge pads to contact the wellbore wall.

Figure 2:
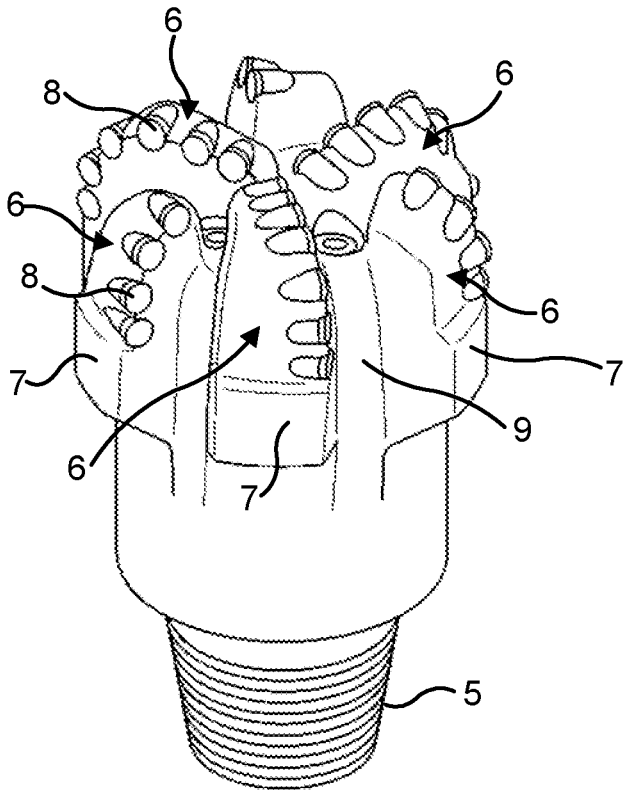
FIG. 2 (prior art)
FIG. 2 is a perspective view of a fixed cutter drill bit.
Figure 4:
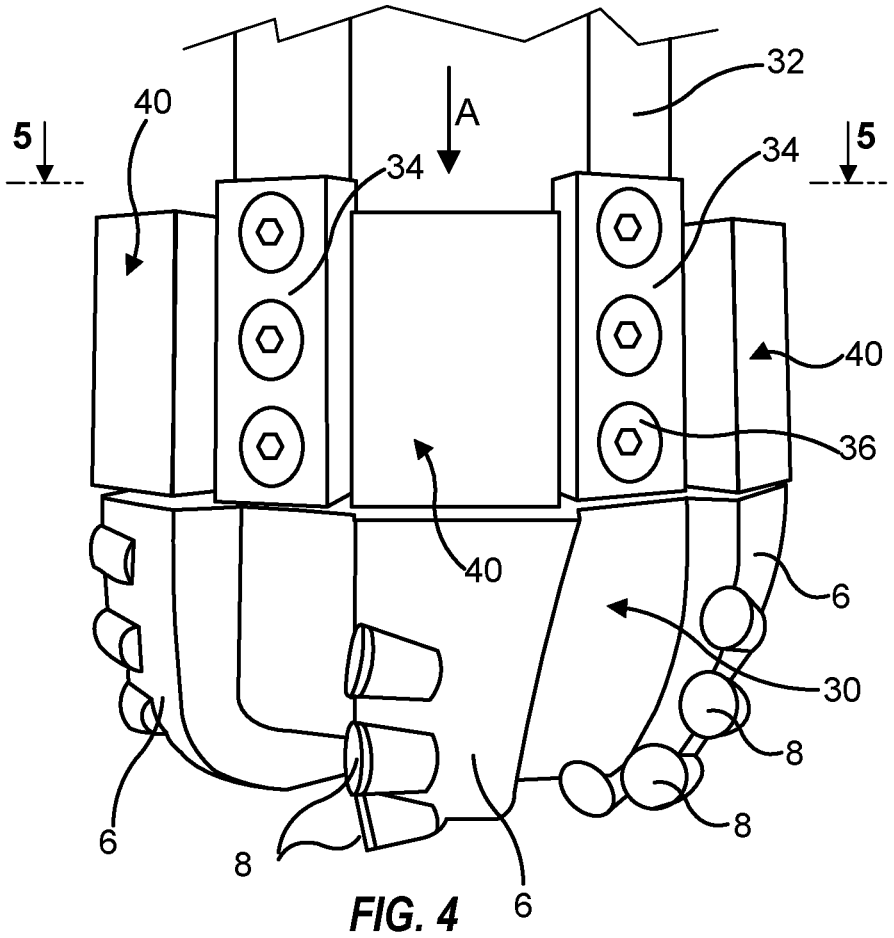
FIG. 4 is a perspective view of a fixed cutter drill bit with sensor-containing units, according to an embodiment of the present disclosure.

FIG. 4 shows a fixed cutter drill bit fitted with cutters for drilling through formations of rock to form a wellbore. This drill bit has a main bit body 30 rigidly connected to a central shank 32 which has a connector (e.g., threaded connection 5 of FIG. 2) at its uphole end for connecting to a BHA or drill string that is employed to rotate the bit and so drill the wellbore. The shank 32 is hollow to allow drilling fluid to flow down to the drill bit.

This drill bit includes blades 6 which are distributed around the bit body 30, and project radially outwardly from the bit body. The blades 6 are separated by so-called junk slots or fluid courses, which are channels allowing for the flow of drilling fluid exiting the drill bit to flow upwardly in the wellbore annulus. Cutters 8 are fitted into cavities (sometimes called pockets) in the blades 6. Example cutters 8 include so-called PDC cutters, which have particles of diamond bonded together to form a cutting face, with that diamond portion bonded to a substrate. The substrate may be formed of tungsten carbide particles which are sintered with a binder. This polycrystalline diamond portion may provide a planar or non-planar cutting face that acts as a hard-cutting surface, and which is exposed at the rotationally leading face of a blade 6. In some embodiments, additional cutters may be placed in back-up or trailing positions along the outer face of a blade, at a position that is offset from the leading face of the blade 6.

Figure 6:
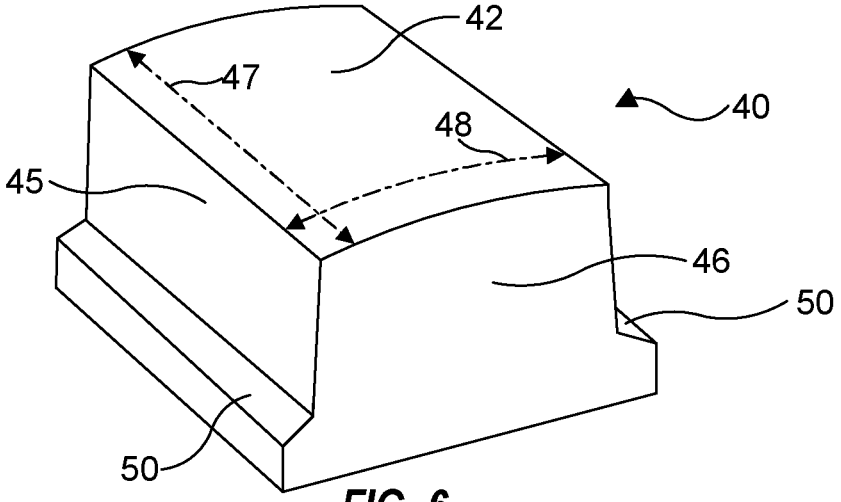
FIG. 6 is a perspective view of the sensor-containing unit of FIGS. 4 and 5.
Figure 7:
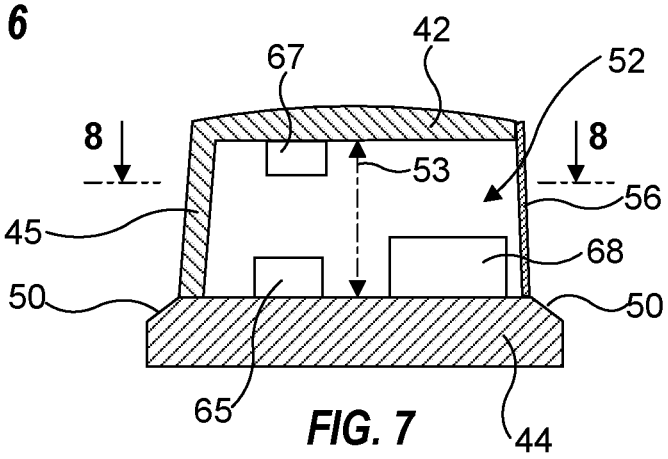
FIG. 7 is a sectional view of the same sensor-containing unit on the line 7-7 of FIG. 8.
Figure 8:
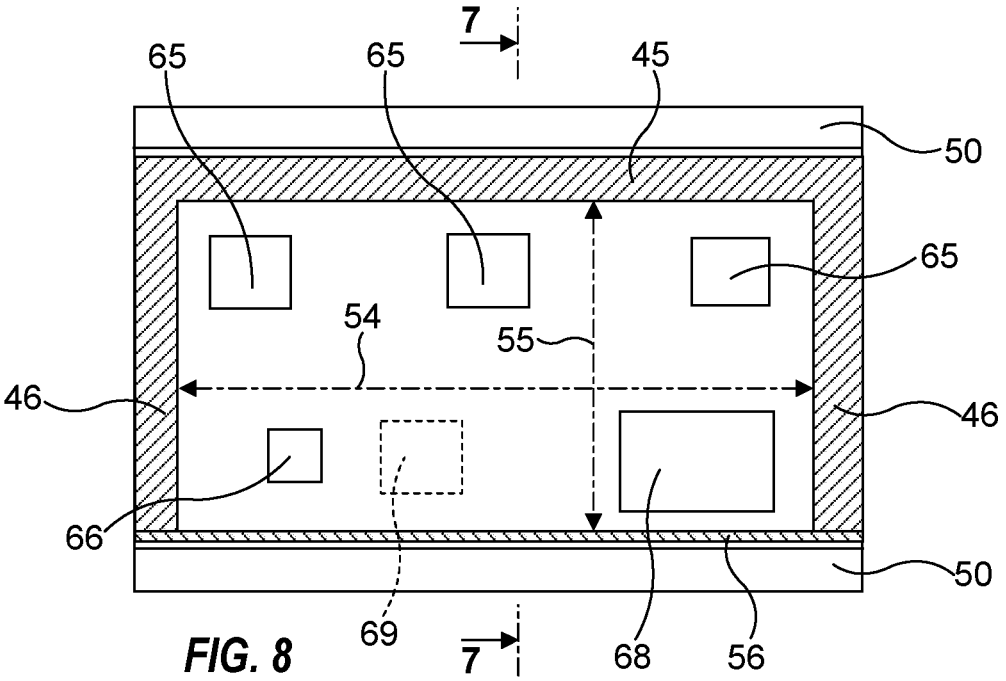
FIG. 8 is a sectional view on line 8-8 of FIG. 7.

In the illustrated embodiment, sensor-containing units 40 are attached to the shank 32 of the drill bit. As shown in FIGS. 6, 7 and 8, the sensor-containing unit 40 includes an exterior portion 42, an attachment portion 44 (or base) opposite the exterior portion 42, a side wall 45, and two end walls 46 which are rigidly connected to both the exterior portion 42 and the attachment portion 44. The axial length of the exterior portion 42 is indicated by arrow 47 and the circumferential width, which is less than the axial length, is indicated by arrow 48. The attachment portion 44 of this embodiment also has a projecting lip 50 along one or more (e.g., each) of the edges extending along the axial length 47.

The construction of the sensor-containing unit 40 of FIGS. 6-8 provides a cavity 52 between the attachment portion 44 and the exterior portion 42. The radial height 53 of this cavity 52 is the distance between the outermost portion of the attachment portion 44 and the innermost portion of the exterior portion 42. The axial length 54 of the cavity 52 is larger than its circumferential width 55 and both of these are larger than radial height 53.

The parts 42, 44, 45 and 46 of a sensor-containing unit 40 may be made as a one-piece article by computerized numerical control (CNC) machining from a block of material (e.g., steel, titanium, Inconel, tungsten, etc.). Another possibility is to make the article as one piece by a casting or an additive manufacturing process. An additive manufacturing process may include selectively depositing material in each layer and/or selectively binding material in each layer, in accordance with a design stored in digital form. Such processes are known by various names including rapid prototyping, layered manufacturing, solid free-form fabrication and 3D printing. Example additive processes which may for instance be used include electron beam welding and selective laser sintering of a powder, which may be steel, tungsten carbide, titanium, etc. In those processes, layers of powder may be deposited one on top of another on a vertically movable build platform. After each layer is deposited, the regions to be bound together are sintered by an electron or laser beam.

The steel structure could also be made as two parts, either by machining, casting, additive manufacturing, or other process, and then joined together. Of course, one part could also be made by a different process than one or more other parts. For instance, the exterior portion 42 together with the side wall 45 and end walls 46 could be made as one piece and then joined to the attachment portion 44 by electron beam welding or laser welding.

Figure 5:
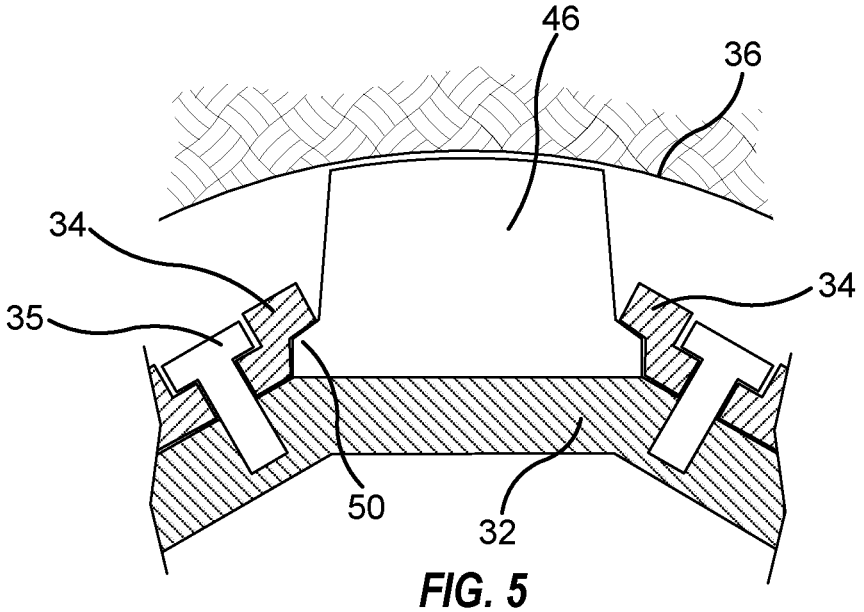
FIG. 5 is a cross-sectional view in the direction of arrow A at line 5-5 of FIG. 4 toward the end of a sensor-containing unit on the drill bit, when the sensor-containing unit is in contact with a borehole wall.

As shown by FIGS. 4 and 5, the sensor-containing units 40 are optionally attached to the shank 32 by elements 34 which may be bars, retainers, and the like. The elements 34 are optionally held to the shank 32 or bit body by bolts 35, and which press the lips 50 of attachment portions 44 onto faces of the shank 32, thus clamping the sensor-containing units 40 in place while allowing the sensor-containing units 40 to be selectively removed and attached. The shank 32 may be round or, as shown in FIG. 5 polygonal, in some embodiments.

In some embodiments, the sensor-containing units 40 are aligned with the blades 6 and so the channels between the blades 6 can continue as gaps between sensor-containing units 40. The exterior portion 42 of each sensor-containing unit has, in this embodiment, a rounded outer surface (e.g., a part cylindrical outer surface having a radius of curvature about equal to the radius of curvature of the wellbore or the radius which is cut by the outermost cutters 8 on the drill bit body 30). The exterior portions 42 of the sensor-containing unit can, in some embodiments, act as gauge pads which make sliding contact with the wall 36 of the borehole as it is drilled, as seen in FIG. 5, and thereby position and potentially stabilize the drill bit in the borehole.

As shown by FIG. 8, within the cavity 52 of a sensor-containing unit 40 there may be multiple sensors (e.g., three accelerometers 65 and a temperature sensor 66) coupled to an electronics package 68 which processes signals from the accelerometers 65 and temperature sensor 66 and which transmits signals onwards. A second temperature sensor 67 is optionally coupled to the underside of the exterior portion 42 and is also connected to the electronics package 68. Example accelerometers 65 may for instance be micro-electro-mechanical systems (MEMS) solid-state accelerometers, such as are available, for example, from Analog Devices, Inc., of Norwood, Mass., USA. After the sensors 65-67 and electronics package 68 have been electronically coupled and positioned within the cavity 52, the cavity may be closed. For instance, a plate 56 opposite side wall 45 may be attached by electron beam welding, brazing, an adhesive, mechanical fasteners, or in other manners.

The free space within the cavity 52 may remain free; however, in other embodiments the free space is filled with a filler material (e.g., an electrically insulating flexible material such as an organic polymer). An example filler material includes a silicone polymer or a polyurethane polymer which is pumped in as a liquid through a small hole in plate 56 or a small gap between components, and then cures in place. This filler material may be a continuous mass of polymer or other material, may be a closed cell foam, or the like. The filler material may restrict and potentially prevent drilling fluid and cuttings from entering the space which is filled. The walls 45, 46 and plate 56 can further shield the sides of the cavity 52 against abrasion by the flow of drilling fluid and entrained drill cuttings.

Placing the sensors 65-67 and electronics 68 within a cavity 52 which is largely enclosed protects the sensors from the abrasive fluid and rock cuttings outside the drill bit. A cavity which is near to the exterior of the drill bit or, as in this embodiment, is within a unit 40 which is fabricated separately from the drill bit to which it is attached, may facilitate the provision of instrumentation on a drill bit because it enables these sensors to be enclosed without forming a cavity buried deep within the main body or structure of the drill bit and avoiding possible difficulty in inserting and electrically connecting sensors within such a buried interior cavity.

Accelerometers, gyros, and other sensors positioned radially outward from the central axis of a drill bit will make different observations than similar sensors located near the central axis. For instance, temperature sensors in a unit 40 will be able to observe the effect of frictional heating as the exterior portions 42 contact the borehole wall. This is of course especially true of sensor 67 attached to the exterior portion 42.

The electronics package 68 may pass signals from the sensors 65-67 onwards to measuring-while-drilling (MWD) equipment located in the drill string (e.g., close to the drill bit). This MWD equipment may transmit the data, possibly after some data processing, to the surface using known technologies for data transmission in a borehole such as mud pulse telemetry or by using wired drill pipe. It is also possible that the electronics package 68 could itself have the capability of communicating to the surface, and it is possible that the electronics package 68 could have the ability to do some signal or data processing before passing signals onwards to the MWD equipment, or could pass processed or unprocessed data to components other than MWD equipment (e.g., a steering system with some processing and transmission capabilities).

There are further possibilities for sensors inside a cavity such as the interior cavity 52 of unit 40. If the unit is made of non-magnetic alloys such as Inconel and the drill bit body is also non-magnetic, one or more small magnetometers may be fitted inside the unit 40, as for instance shown in broken lines at 69. Small magnetometers are available as components for electronics industries and one example supplier is NXP Semiconductors in Eindhoven, Netherlands.

The interior cavity 52 of the sensor-containing unit 40 may be at a pressure similar to the external pressure around the drill bit. For instance, if the flexible filler within the unit 40 is compressible by external pressure, the pressure inside the cavity 52 may be about equal to the pressure outside the cavity. If so, a pressure sensor (which could also be represented by unit 69) to measure downhole pressure may be located within the unit 40. One supplier of small piezoresistive pressure sensors is Kulite Semiconductor Products Inc. in New Jersey, USA.

Figure 9:
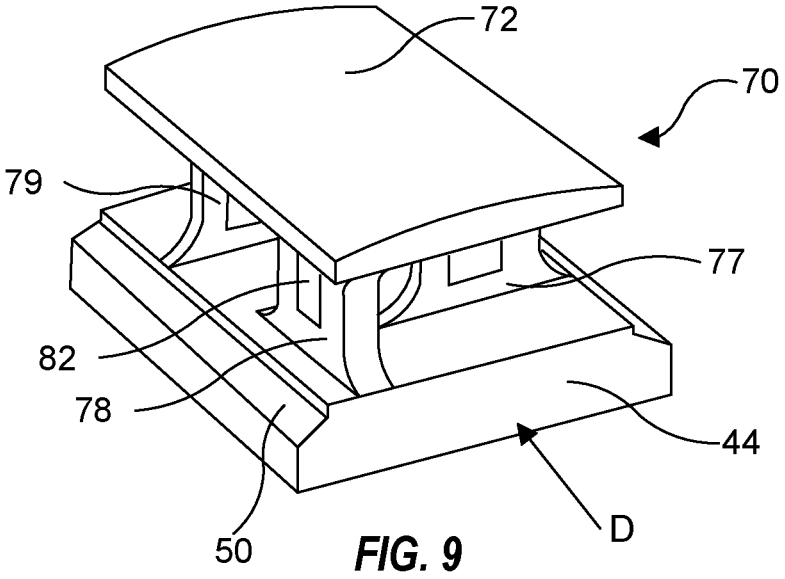
FIG. 9 is a perspective view of another sensor-containing unit omitting a protective skirt, according to an embodiment of the present disclosure.
Figure 10:
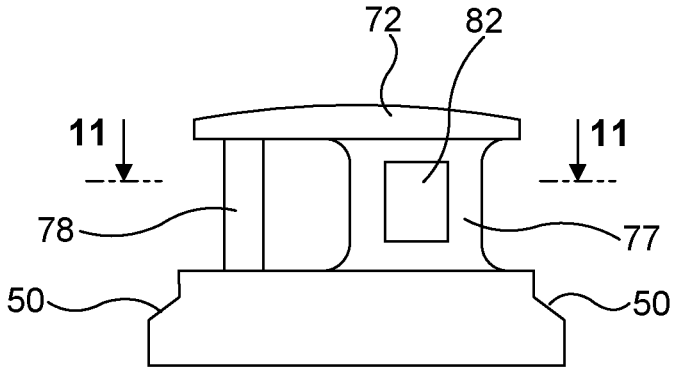
FIG. 10 is an end view of the sensor-containing unit of FIG. 9 seen in the direction of arrow D of FIGS. 9 and 11.
Figure 11:
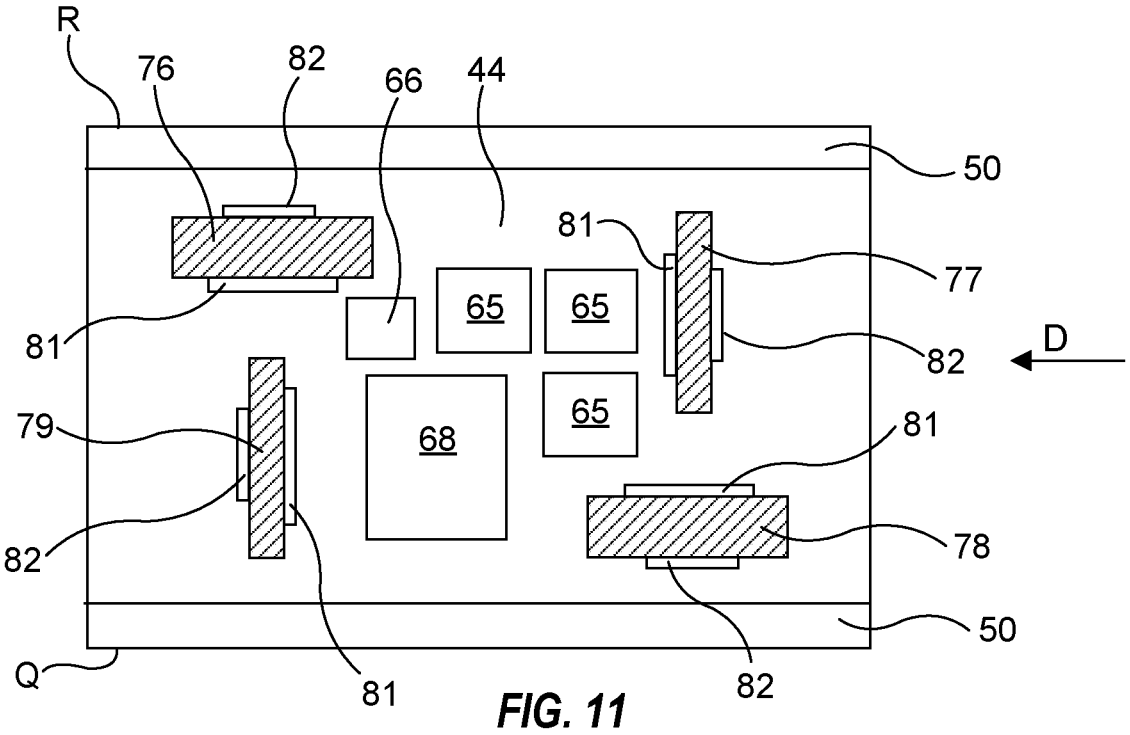
FIG. 11 is a sectional view on line 11-11 of FIG. 10.

FIGS. 9, 10 and 11 show another form of sensor-containing unit 70 which has the same overall outline and size as the unit 40. Units of this type may be attached to the shank 32 of the drill bit shown in FIG. 4 using the bars 34 and bolts 35 in the same manner as shown in FIGS. 4 and 5 for the units 40. The attachment portion 44 of the sensor-containing unit 70 may include a radially innermost surface that is flat for coupling to a polygonal shank 32, or may be rounded to attach to a cylindrical shank 32. As shown in FIGS. 9-11, a sensor-containing unit 70 has a structure (e.g., steel or other metal) with an attachment portion 44 which is the same as in FIGS. 6-8, an exterior portion 72 which is spaced from the attachment portion 44, and four connecting portions 76-79 that are rigidly connected to both the exterior portion 72 and the attachment portion 44. This structure may be made as one piece, or as a plurality of pieces welded or otherwise coupled together, by techniques as mentioned herein.

The radial spacing between the attachment portion 44 and the exterior portion 72 provides a cavity in which are located the accelerometers 65, a temperature sensor 66, and an electronics package 68 that processes outputs from the various sensors. These are elements can be coupled to the attachment portion 44 or other portions of the sensor-containing unit 40. The accelerometers 65 are optionally arranged in a suitable manner to measure accelerations along three orthogonal axes. In this embodiment, the connecting portions 76-79 extend through this cavity and electrical strain gauges 81-83 are attached to these connecting portions to observe distortion by stresses on the exterior portion 72, to thereby resolve and measure the forces on the exterior portion 72. The strain gauges 81-83 may take any suitable form, but the interconnections to resolve forces into separate components may be made as discussed herein.

Referring to FIG. 11, the connecting portions 77 and 79 of this embodiment extend parallel to the shorter edges of the exterior portion 72 and attachment portion 44, which in this embodiment may be the edges that extend circumferentially relative to the drill bit axis. The connecting portions 76 and 78, which are in this embodiment thicker than the connecting portions 77 and 79, optionally lie parallel to the longer edges of the exterior portion 72, which in this embodiment may be parallel to the axis of the drill bit. It is apparent from the drawings that the four connecting portions 76-79 taken together have a total cross-sectional area (as shown in FIG. 11 this cross-sectional area is transverse to radii from the tool axis and so facing toward the conduit wall as does the exterior portion) which is much less than the area of the inner and outer surfaces of the exterior portion 72, and likewise less than the area of the inner or outer surfaces of the attachment portion 44. In some embodiments, the total cross-sectional area of the connecting portions 76-79 is much less than the area of the outer surface of the outer portion 42 and the area of the inner surface of the attachment portion 44, and is within a range including a lower limit, an upper limit, or lower and upper limits including any of 5%, 10%, 20%, 30$, 40%, or 50% of the area of the outer surface of the outer portion 42, the area of the inner surface of the attachment portion 44, or both.

With a reduced cross-sectional area, the connecting portions 46-49 can be more compliant than the outer portion 42 and the attachment portion 44. In use, forces acting on exterior portion 72, relative to the main structure of the drill bit, can cause elastic strains (also referred to as distortions) of these connecting portions. The electrical resistance strain gauges 81-83 attached to flat or otherwise shaped faces of the connecting portions 76-79 are used to measure such strains and hence measure the forces causing the strains. As explained in more detail herein, strain gauges 81 can be used to measure radial forces while optionally excluding circumferential and axial forces. The strain gauges 82 are optionally responsive to circumferential forces only (excluding radial and axial forces) and the other strain gauges 83 are optionally responsive to axial forces only (excluding circumferential and radial forces). It should also be appreciated that increased compliance of one or more connecting portions 76-79 can be produced in other ways, besides having reduced cross-sectional areas. For instance, the connecting portions 76-79 may be formed of a different, and more compliant material. For instance, the connecting portions 76-79 may be formed of a steel material that is more flexible than a different steel material (or differently heat treated steel material) used for the outer portion 42 and/or attachment portion 44.

The various gauges used in this example embodiment can each observe strain by means of an electrically conductive but somewhat resistive path deposited on a piece of thin electrically insulating polymer sheet referred to herein as a carrier. The carrier may be adhered to a face of a connecting portion to be observed. If stress causes an area of the connecting portion to which a strain gauge is adhered to stretch slightly, the carrier and the conductive path also lengthen and the resistance of the conductive path increases. Conversely, if the conductive path is shortened, its resistance decreases. Such strain gauges of this type are available from numerous manufacturers and component suppliers including HBM Inc. in Marlborough, Mass., USA, HBM United Kingdom Ltd in Harrow, UK, and National Instruments in Newbury, UK and Austin, Tex., USA. Adhesives for attaching strain gauges to steel are available from manufacturers of strain gauges and may be a two-part epoxy adhesive.

Each of the strain gauges 81-83 can include, in some embodiments, a pair of gauges in proximity to each other on a single carrier. The conductive path of one gauge can run perpendicular to the conductive path of the proximate gauge. Such pairing of gauges can incorporate compensation for temperature variation by orienting the gauges so that only one gauge of the pair is subject to strain to be measured while both of them are exposed to the surrounding temperature.

Figure 12:
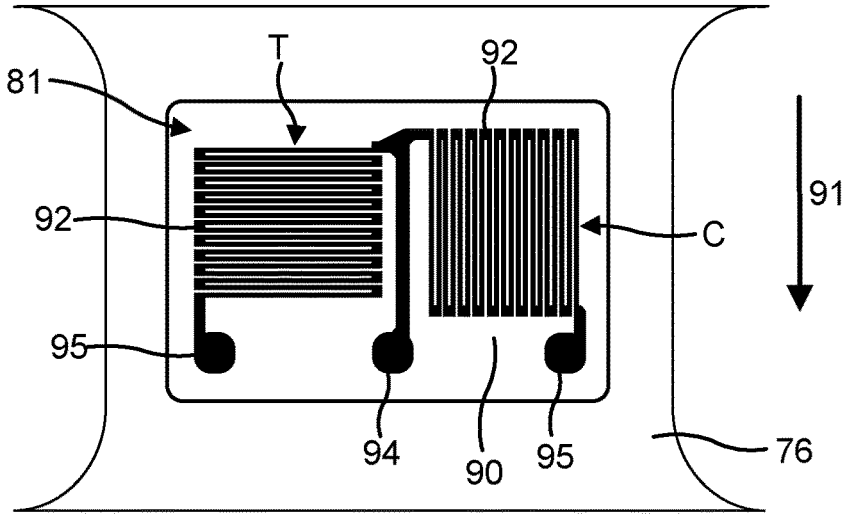
FIG. 12 shows a Poisson gauge adhered to a flat face of a connecting portion, according to an embodiment.

FIG. 12 is an enlarged view of a gauge 81 which includes a pair of strain gauges having conductive paths deposited on, or otherwise applied to, a single carrier 90. The carrier 90 may be coupled to a connecting portion such as those described herein. In the region C, which is to the right as shown, a strain gauge is provided by a conductive path which extends to and fro many times parallel to the radial direction indicated by the arrow 91. This provides a length of conductive path which is subject to strain when the underlying connecting portion undergoes strain in the direction of the arrow 91. If the strain shortens the carrier 90 in the direction of the arrow 91, the strain will correspondingly shorten the conductive path in the region C in the same direction, causing decrease in resistance of the conductive path. Conversely, if there is strain which elongates the conductive path in region C, resistance rises. The reverse turns 92 in the conductive path are thickened in the illustrated embodiment, to reduce resistance in those parts of the path which are transverse to the direction of arrow 91.

In the region T, a second gauge is provided by a conductive path running to and fro transverse/perpendicular to the arrow 91. The resistance of the conductive path in this region T is not affected by strain parallel to the arrow 91. The conductive paths in regions C and T are connected to each other and to a solder tab 94 on the supporting carrier 90. The other ends of these two conductive paths are connected to separate solder tabs 95. A strain gauge 81 of the kind shown in FIG. 12 is sometimes referred to as a Poisson gauge.

On each connecting portion 76-79, the Poisson gauge 81 provides a gauge as indicated at C of FIG. 12, with a conductive path running in the direction of compressive strain resulting from radial force on the exterior portion 72 (e.g., parallel to arrow 91). These strain gauges will be referred to as 76C-79C. The Poisson gauge 81 on each connecting portion can also provide a strain gauge as indicated at T of FIG. 12 with a conductive path transverse/perpendicular to the direction of compressive strain (e.g., perpendicular to arrow 91). These strain gauges will be referred to as 76T-79T.

Figure 13:
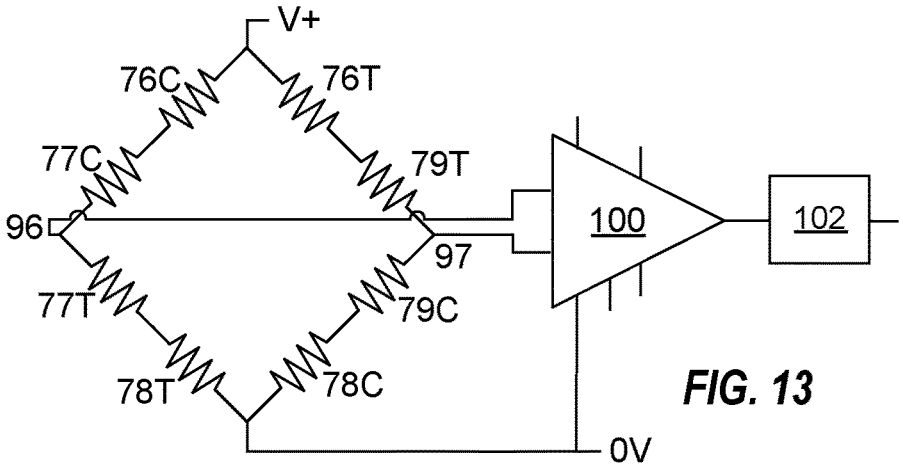
FIG. 13 is a circuit diagram showing connection of Poisson gauges of a sensor-containing unit, according to an embodiment.

The circuit diagram of FIG. 13 shows how the individual strain gauges 76C-79C and 76T-79T are connected in a Wheatstone bridge circuit with two gauges in each arm of the bridge. A fixed supply voltage V+ is connected to the solder tab 94 of the Poisson gauge 81 on connecting portion 76 and ground (0V) is connected to the solder tab 94 of the Poisson gauge 81 on connecting portion 78. The solder tabs 94 of the Poisson gauges on connecting portions 77 and 79 are outputs 96 and 97 from the Wheatstone bridge, and these are connected as inputs to differential amplifier 100, which may be included in the electronics package 68 (see FIG. 11). The solder tabs 95 on the four Poisson gauges are optionally used for connections between the individual gauges in each arm of the Wheatstone bridge.

When radial force on the exterior portion 72 of the sensor-containing unit 70 compresses the four connecting portions 76-79 and the carrier 90 of the Poisson gauge 81 on each connecting portion, this shortens the conductive paths of gauges 76C-79C and reduces their resistance. The gauges 76T-79T may not be affected due to their different orientation/arrangement. Consequently, the potential of output 96 from the Wheatstone bridge increases and the potential of 97 decreases. The resulting change in potential difference between 96 and 97 is amplified by the differential amplifier 100 and is a measurement of radial compressive strain and hence of radial force. Further, any change in the temperature of the gauges can affect their resistance, but so long as this affects all the individual gauges 76C-79C and 76T-79T equally, changes in temperature will not cause any change in the voltage difference between 96 and 97 and in the output from the amplifier 100. Output from the differential amplifier 100 may be converted to digital form by an analog to digital converter 102 within the electronics package 68.

Figure 14:
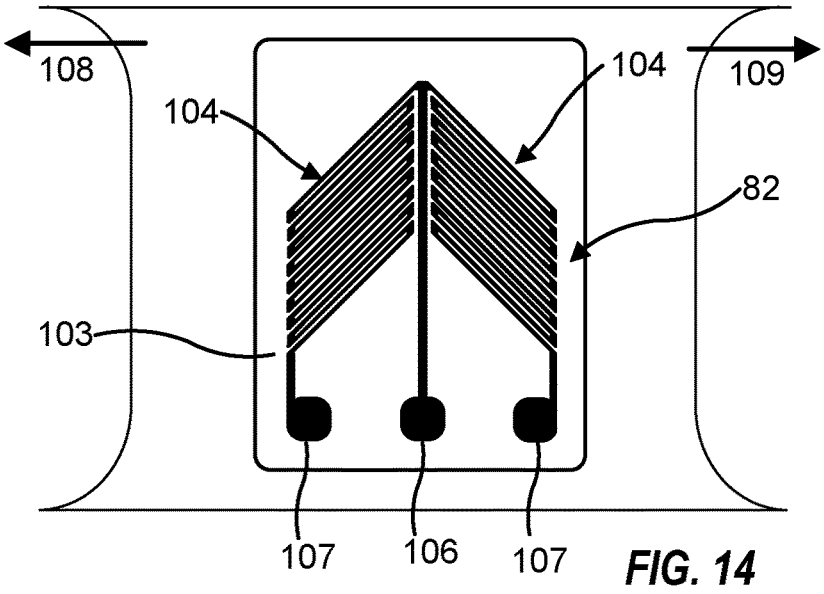
FIG. 14 shows a chevron gauge coupled to a flat face of a connecting portion, according to an embodiment.

FIG. 14 is an enlarged view of a strain gauge 82 on connecting portion 77. This gauge 82 comprises a pair of individual strain gauges provided by conductive paths connected together on a single carrier 103. The conductive paths in the regions 104 at the left and right of FIG. 14 are perpendicular to each other although both are diagonal relative to the edges of the carrier 103 and the edges of the connecting portion 47 (e.g., axial and radial edges). The two gauges are connected together and to a common solder tab 106 while the other ends of the two conductive paths are connected to respective solder tabs 107. A gauge 82 including a pair of gauges with a configuration shown in FIG. 14 is commonly referred to as a chevron gauge.

The chevron gauges 82 on the connecting portions 77 and 79 may be oriented so that circumferential force on the exterior portion 72 of the sensor-containing unit 70 (i.e., force acting in a circumferential direction relative to the tool axis and therefore tangential to the direction of rotation) will act in the direction of the arrow 108 or the opposite arrow 109 shown in FIG. 14. Force in the direction of arrow 108 causes shear strain of the connecting portions 77, 79 and the attached chevron gauges 82, so that one conductive path 104 of each chevron gauge 82 will lengthen and the other will shorten. In the case of the connecting portion 77 shown in FIG. 14, force in the direction of arrow 108 will lengthen the conductive path 104 at the right and its resistance will increase while the conductive path 104 at the left will shorten and its resistance will decrease.

Figure 15:
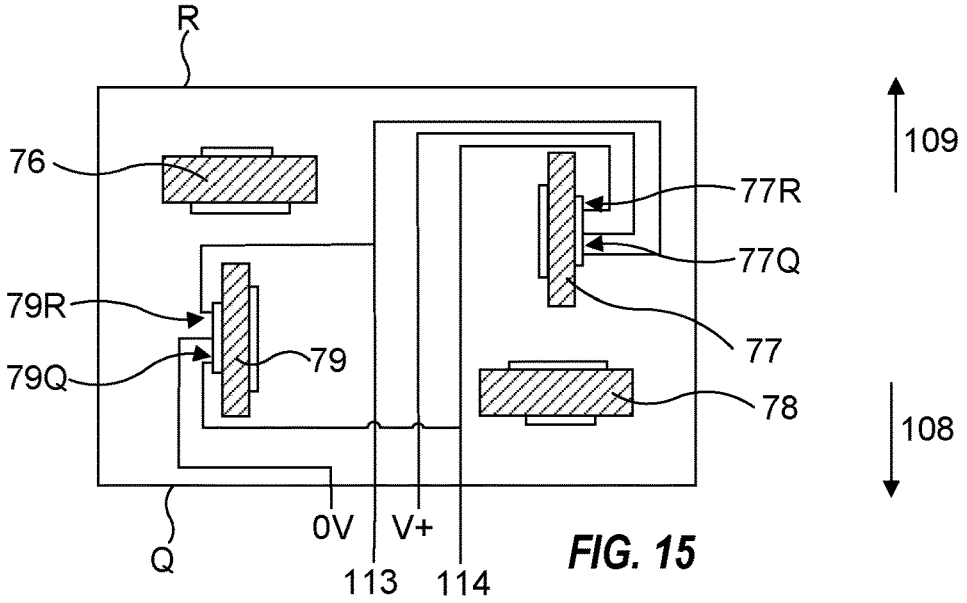
FIG. 15 shows connections between two chevron gauges of a sensor-containing unit, according to an embodiment.
Figure 16:
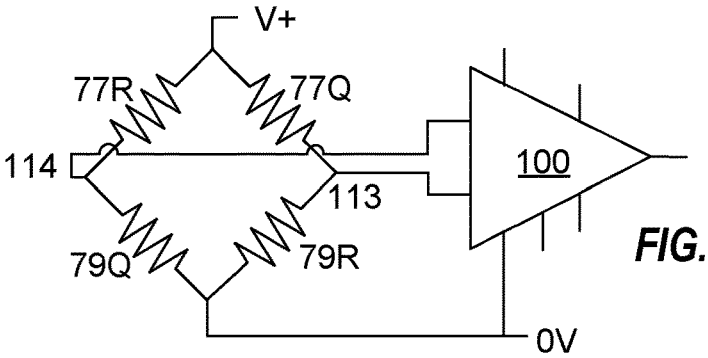
FIG. 16 is a circuit diagram corresponding to the sensor-containing unit of FIG. 15.

FIGS. 15 and 16 show how two chevron gauges 82 on connecting portions 77 and 79 can be used to measure strain resulting from circumferential force(s). The individual gauge (i.e., conductive path 104) at the left of FIG. 14 is of course nearer to the longitudinal edge Q of the force-sensitive element 70 than to the opposite edge R and this gauge appears as resistance 77Q in the circuit diagram shown as FIG. 16. The other individual gauges on the connecting portions 77 and 79 appear as 77R, 79Q and 79R in FIGS. 15 and 16 according to whether they are at the chevron gauge edge which is nearer to longitudinal edge Q or R. These individual gauges are connected into a Wheatstone bridge as shown in FIG. 16. Outputs 113 and 114 from this Wheatstone bridge are inputs to another differential amplifier 100 within the electronics package 68. Circumferential force in the direction of arrow 108 will give torsional strain of connecting portions 77 and 79, shortening the conductive paths of gauges 77Q and 79Q while stretching the conductive paths of gauges 77R and 79R. This will increase the voltage at 113 and reduce the voltage at 114, thus changing the voltage difference between 113 and 114. This change is amplified by the differential amplifier 100. Circumferential force in the opposite direction 109, will give opposite effects, thereby reducing the voltage at 114 relative to 113.

Gauges 82 may be positioned to respond to circumferential forces which cause shear strain, and not to respond to axial forces on the exterior portion 72. In some embodiments, radial force transmitted to a gauge 82 or a change in temperature will not produce a response because it will affect the conductive paths 104 of that gauge 82 equally and the voltage difference between 113 and 114 will stay substantially unchanged.

The gauges 83 on the connecting portions 76 and 78 can also be chevron gauges of the type shown by FIG. 14. Shear strain of these connecting portions 76 and 78, resulting from force acting on the exterior portion 72 in the axial direction, may be detected by these chevron gauges 83 which are connected into a Wheatstone bridge circuit in a manner directly analogous to that shown in FIGS. 15 and 16.

Overall, the described configuration of Poisson gauges 81 and chevron gauges 82, 83 on connecting portions 76-79 which extend axially and circumferentially is able to separate components of force acting radially, circumferentially, and axially on the exterior portion 72 of the sensor-containing unit 70. A further possibility in some embodiments is that an accelerometer attached to the underside of the exterior portion 72 will be able to detect resonant frequencies of the exterior portion 72. Monitoring such resonant frequencies over time may provide an indication of the extent to which the exterior portion 72 has been worn away by the frictional contact with the borehole wall.

Figure 17:
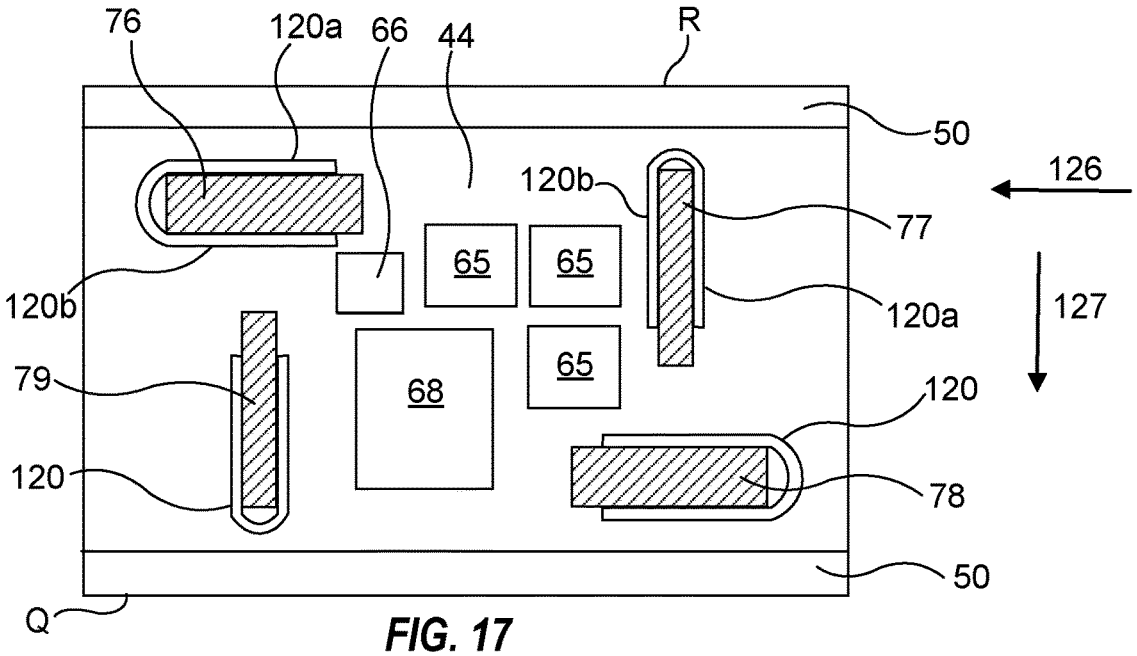
FIG. 17 is a sectional view of a sensor-containing unit, according to a further embodiment.
Figure 18:
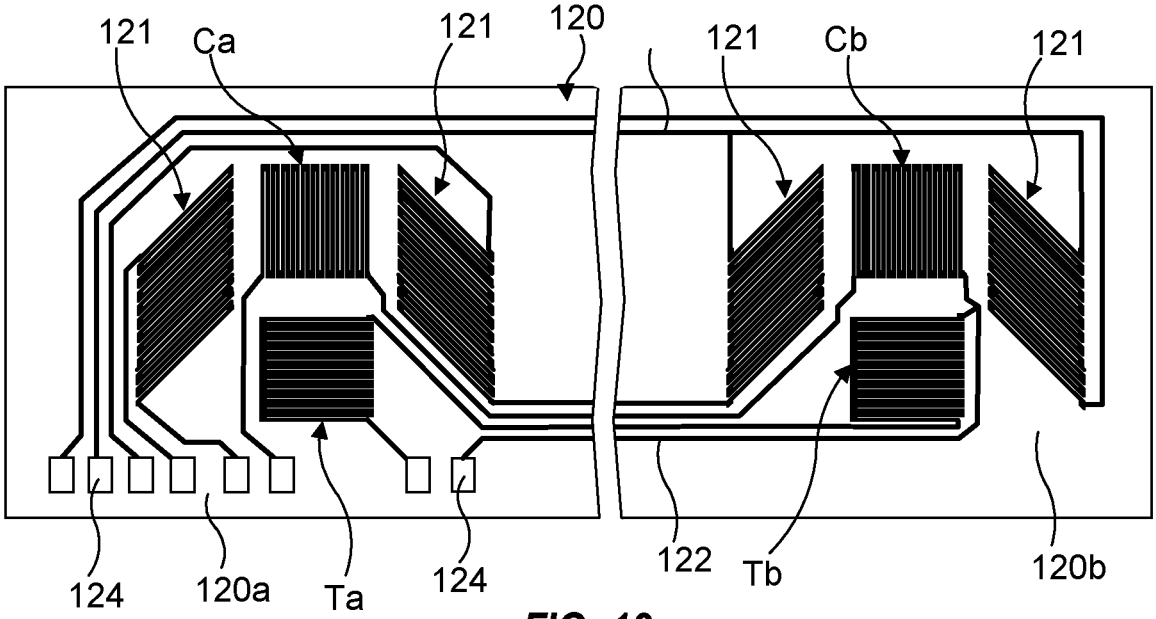
FIG. 18 is an enlarged view of a carrier used in the embodiment of FIG. 17.

FIGS. 17 to 23 show an embodiment of force-sensitive element with additional provision for separation of forces acting on it. The structure of this element can be the same as described with reference to FIGS. 6 to 8, and the same reference numerals are used. A carrier 120 on which individual strain gauges have been deposited or otherwise positions is attached to each of the connecting portions 76-79. As above, each individual strain gauge provides a conductive path on the carrier which extends to and fro various times. The enlarged view of a carrier 120 and gauges at FIG. 18 shows that there are eight individual gauges on the carrier 120, arranged in two groups of four with connections 122 between the groups and connections to solder tabs 124, although more or fewer individual gauges may be used in other embodiments.

Figure 19:
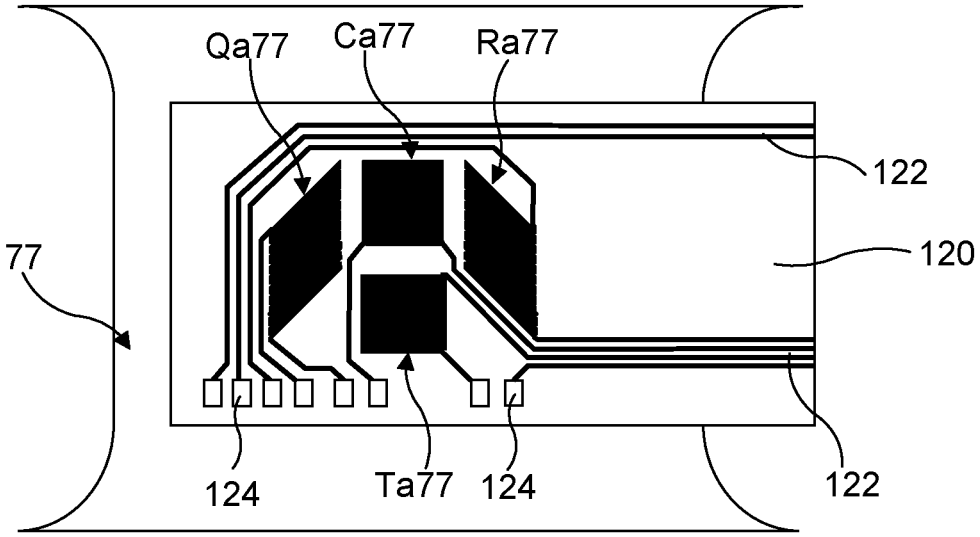
FIG. 19 is a view of a carrier coupled to a face of a connecting portion of a sensor-containing unit, according to an embodiment.

Each carrier 120 may be wrapped or folded around one of the connecting portions 76-79 as shown in FIG. 17, so that portions 120*a* and 120*b* of the carrier—which each bear four individual gauges—are adhered or otherwise coupled to the two broad faces of the connecting portion. As an illustration of this, FIG. 19 shows portion 120*a* as at the left of FIG. 18, bearing four individual gauges and adhered to one face of connecting portion 77 (e.g., a face having an axial length and a radial height).

As shown by FIG. 18, each group of four individual gauges includes individual gauges C and T which operate as a Poisson gauge similar to the Poisson gauge shown in FIG. 12, and two further gauges 121 which together function as a chevron gauge similarly to the gauge shown in FIG. 14.

Figure 20:
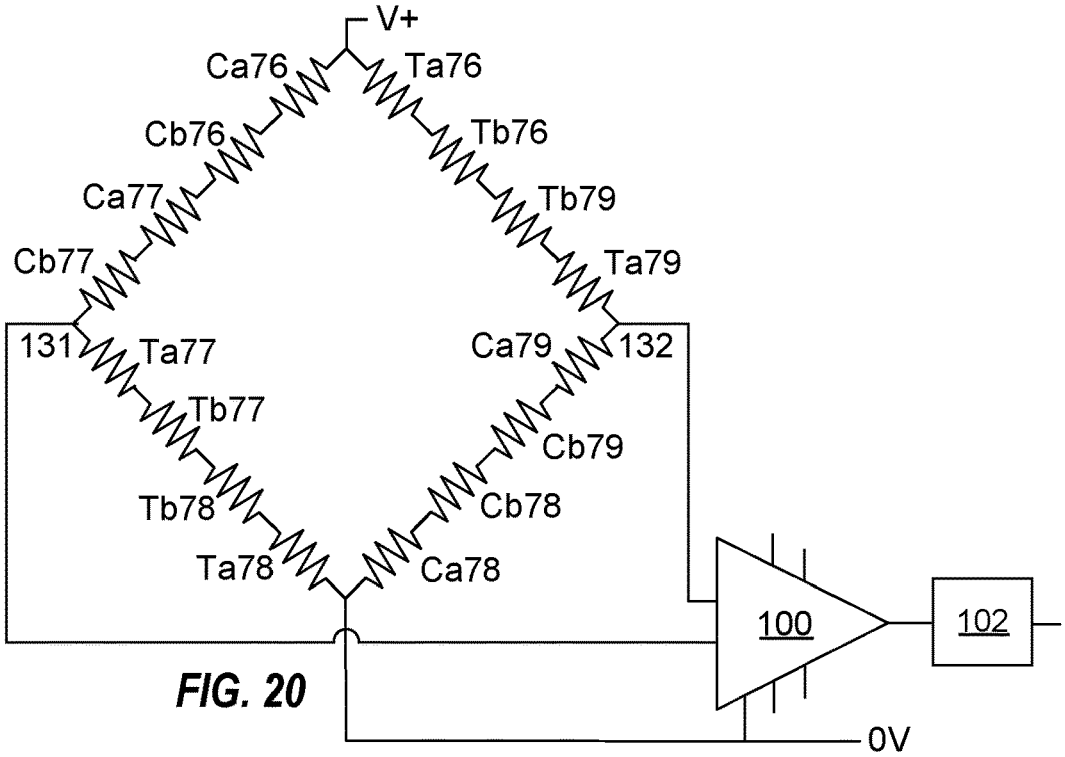
FIGS. 20 to 22 are circuit diagrams for a sensor-containing unit similar to that of the embodiment of FIG. 17.
Figure 21:
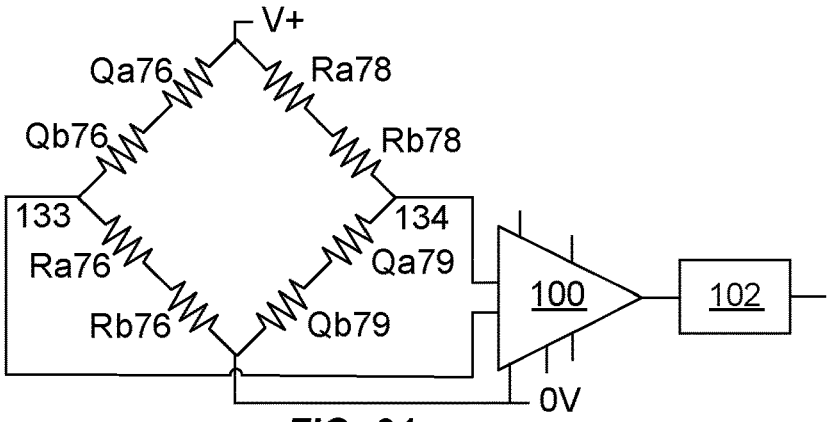
Figure 22:
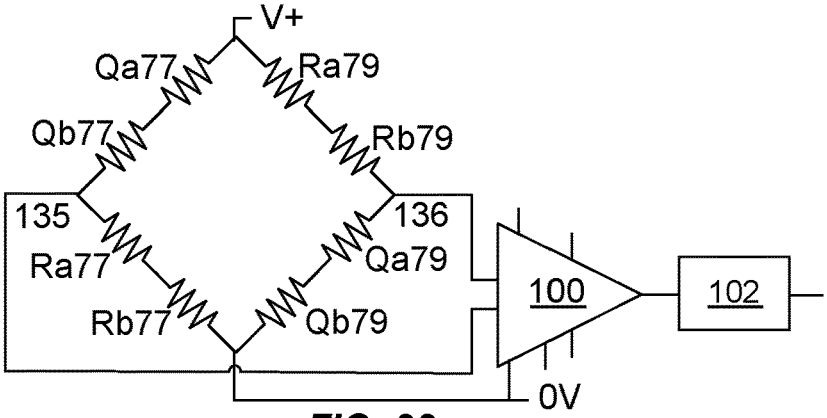

In the following description of circuitry, the gauge C on portion 120*a* of the carrier attached to connecting portion 76 is designated as gauge Ca76. Corresponding designations are used for the other individual gauges. The individual C and T gauges which form Poisson gauges are each connected in a Wheatstone bridge circuit as shown by FIG. 20. The C gauges on connecting portions 76 and 77 are connected in series in one arm of the bridge. The C gauges on connecting portions 78 and 79 are connected in series in the opposite arm of the Wheatstone bridge. The gauges 121 on the connecting portions 76 and 78, which respond to axial force components parallel to the arrow 126 shown in FIG. 17 are connected in a separate Wheatstone bridge circuit shown in FIG. 21. The gauges 121 on the connecting portions 77 and 79, which respond to circumferential force components parallel to the arrow 127 are connected in a third Wheatstone bridge circuit shown in FIG. 22. Gauges 121 which are shortened by force components in the direction of arrow 126 or arrow 127 appear in FIGS. 21 and 22 as resistances Q, while gauges which are lengthened by force components in the directs of arrows 126 or 127 appear as resistances R.

Although this embodiment has more individual gauges than some of the embodiments shown in FIGS. 7 to 16, forces on the exterior portion 42 of the sensor-containing units 40 are separated into radial, axial, and circumferential components in the same manner as in the embodiment of FIGS. 7 to 16. Radial force shortens the conductive parts of gauges C without affecting the gauges T, leading to a change in potential difference between points 131 and 132. Radial force affects the two individual (i.e., Q and R) gauges of a chevron gauge equally, and so does not alter the potential difference between points 133 and 134 nor between 135 and 136 of the circuits shown in FIGS. 21 and 22. Axial force in the direction shown by arrow 126 in FIG. 17 will stretch the Q gauges and compress the R gauges on connecting portions 76 and 78, leading to a change in potential between the points 133 and 134. Similarly, circumferential force in the direction shown by arrow 127 will stretch the Q gauges and compress the R gauges on connecting portions 47 and 49 leading to a change in potential between the points 135 and 136. When axial or circumferential forces cause shear strain of a connecting portion the shear strain does not lengthen or shorten the C and T gauges subjected to the shear strain.

The provision of four identical individual gauges C, T, Q, and R on both faces of each connecting portion 76-79 serves to exclude effects arising from bending strain of the connecting portions. For instance, circumferential force acting in the direction of arrow 126 (observed by shear strain of connecting portions 77 and 79) will cause bending of the two connecting portions 76 and 78, leading to stretching of Q, R, and T gauges on one face of each of these two connecting portions and compression of the Q, R and T gauges on the opposite face. However, it can be seen from FIGS. 20 to 22 that each of the four individual gauges of portion 120*a* on one face of a connecting portion is connected in series with the corresponding gauge of portion 120*b*. For instance, Ta76 and Tb76 are in series and in one arm of a Wheatstone bridge shown in FIG. 20. Qa76 and Qb76 are in series in one arm of the Wheatstone bridge shown in FIG. 21.

Bending of one or more connecting portions may result from axial or circumferential shear forces or from radial force which is not central on the outer portion 72 of a sensor-containing unit. Regardless of cause, when there is bending strain of any connecting portion, the resulting stretching of any gauge on one face of that connecting portion is compensated by compression of the corresponding gauge on the opposite face of the same connecting portion so that the total resistance of the two gauges which are connected in series remains the same, and bending strain of connecting portions is eliminated from the measured data.

Figure 23:
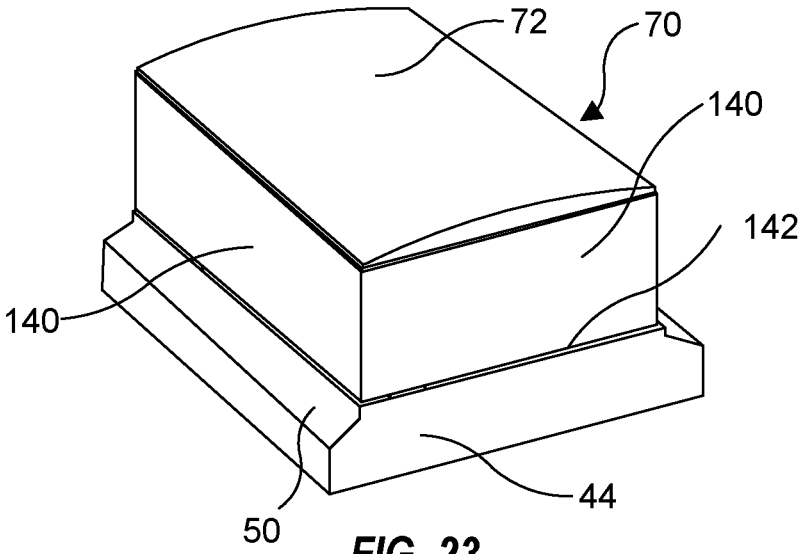
FIG. 23 is a perspective view of a sensor-containing unit similar to that of FIG. 9, after attaching a protective skirt.

Referring to FIG. 23, after the structure of a force-sensitive element 40 or 70 similar to that shown in FIGS. 6 to 11 has been made and equipped with sensors 65-67, or equipped with strain gauges on carriers 90 or 120 as shown in FIGS. 12 and 18, and also equipped with wiring for electrical connections to an electronics package 68 (or with the electronics package 68 itself), a protective skirt 140 can be attached to the force-sensitive element. The skirt 140 can be made of sheet metal, machined metal, multiple components, or the like, and coupled to the sides of the outer portion 42 or 72 (or optionally to the attachment portion 44) in any suitable manner, such as by electron beam welding. This skirt 140 may be dimensioned such that its radially inner edge 142 is close to, but slightly spaced from, the attachment portion 44. Consequently, force on the outer portion 42 or 72 can strain the connecting portions 76-79 without being impeded by contact between the skirt 140 and the attachment portion 44. The converse can also be done, where the radially outer edge can be close to, but slightly spaced from, the outer portion 42 or 72. The volume inside the skirt 140, between the outer and attachment portions 42/72 and 44 may be filled with electrically insulating flexible filler material as described herein. The skirt 140 and the filler material can protect the strain gauges from abrasion by the flow of drilling fluid and entrained drill cuttings without affecting measurements by the strain gauges.

Sensor-containing units disclosed herein are generally provided with protective skirts and filling but, to assist explanation of the component parts and sensors within the cavity, the enclosing skirts and filling are omitted from many of the drawings.

Figure 24:
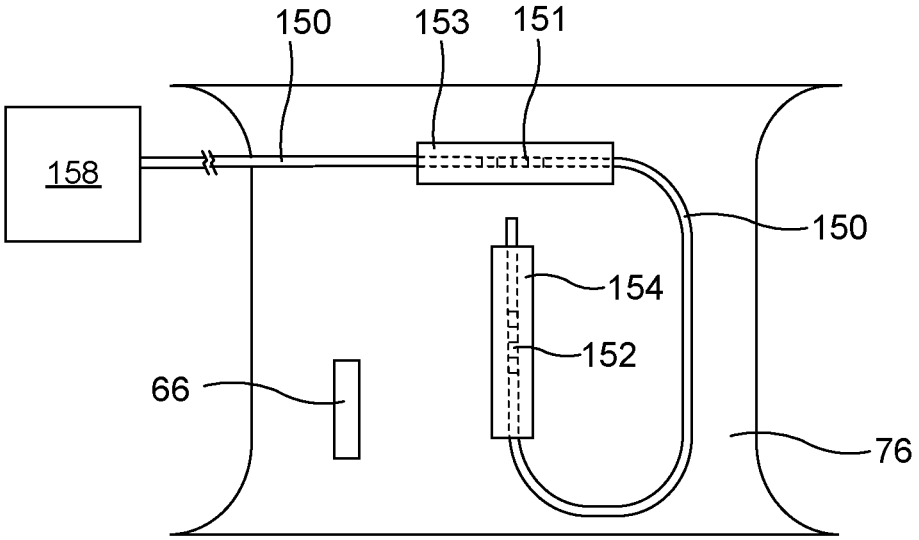
FIG. 24 shows fiber Bragg sensors coupled to a flat face of a connecting portion, according to an embodiment.

Other types of sensors could be used on connecting portions 76-79 in place of the electrical strain gauges described herein. One possibility illustrated by FIG. 24 is optical sensors based on fiber Bragg gratings. A Bragg grating is formed in optical fiber by creating systematic variation of reflective index within a short length of the fiber. The grating selectively reflects light of a specific wavelength which is dependent on the spacing of the grating. Strain of the fiber alters the spacing of the grating and so alters the wavelength at which reflection by the grating is at a maximum because there is maximum constructive interference.

Patent literature on the creation of Bragg gratings by means of ultraviolet light to irradiate a photosensitive optical fiber includes U.S. Pat. Nos. 5,956,442 and 5,309,260 along with documents referred to therein, each of which are incorporated herein by this reference. Strain sensors based on Bragg grating in optical fiber are available from a number of suppliers including HBM and National Instruments.

FIG. 24 shows a connecting portion 76, which differs from that shown in FIGS. 9 to 11 in that it is fitted with two fiber Bragg sensors instead of electrical resistance strain gauges. The two sensors are formed in a single optical fiber 150. Regions with systematic refractive index variations are formed at 151 and 152. Portions of fiber containing these regions are adhered within flat substrates 153 and 154 respectively. Both of these substrates are adhered or otherwise coupled to the connecting portion 76 which is oriented such that sensors on it are not responsive to circumferential force on the exterior portion 72. The substrate 153 containing grating 152 is positioned perpendicular to the radial direction (e.g., in an axial direction) so as to be responsive to strain caused by axial forces but not by radial force while the substrate 154 containing grating 152 is positioned in the radial direction so as to be responsive to radial force but not axial force.

In use, the optical fiber 150 is optionally coupled to an interrogating device indicated schematically at 138, which directs light of varying wavelengths along the fiber 150, receives the reflection, and determines the wavelength at which reflectance is greatest. Observed changes in this wavelength are proportional to the strain and in turn proportional to the force causing strain of the connecting portion. The gratings 151 and 152 are made with different spacings so that they reflect different wavelengths. Consequently, both can be interrogated by the same device 158 transmitting and receiving light along the common optical fiber.

The output from the interrogating device 158 may be in digital form and may be processed by computer/processor to give measurements of strain and hence of force on the exterior portion 72. The Bragg gratings are sensitive to temperature as well as strain. Measurements of temperature by the sensor 66 enables correction for the effects of temperature variation.

Fiber Bragg sensors may be provided on both of the connecting portions 76, 78 to measure axial and radial forces on exterior portion 72. Fiber Bragg sensors may also be provided on both the connecting portions 77 and 79 to measure strain of these connecting portions by circumferential and radial forces.

Another technology which may possibly be used for strain sensors on the connecting portions 76-79 is piezoresistive sensors, which are also known as "semiconductor strain gauges". Such sensors have an electrically conductive path which includes a semiconducting material. The electrical resistance of this material is affected by strain of the material causing a change of interatomic-spacing within the semiconductor. The change in resistance in response to strain is greater than with electrical resistance sensors. Suppliers of such gauges include Micron Instruments in Simi Valley, Calif., USA and Kulite Semiconductor Products Inc. in New Jersey, USA.

Figure 3:
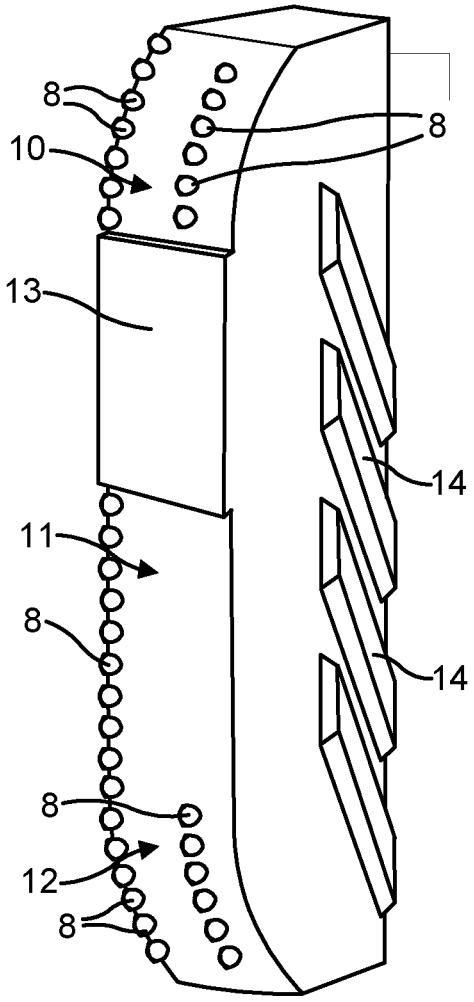
FIG. 3 (prior art)
FIG. 3 is a perspective view of a cutter block for an expandable reamer.
Figure 25:
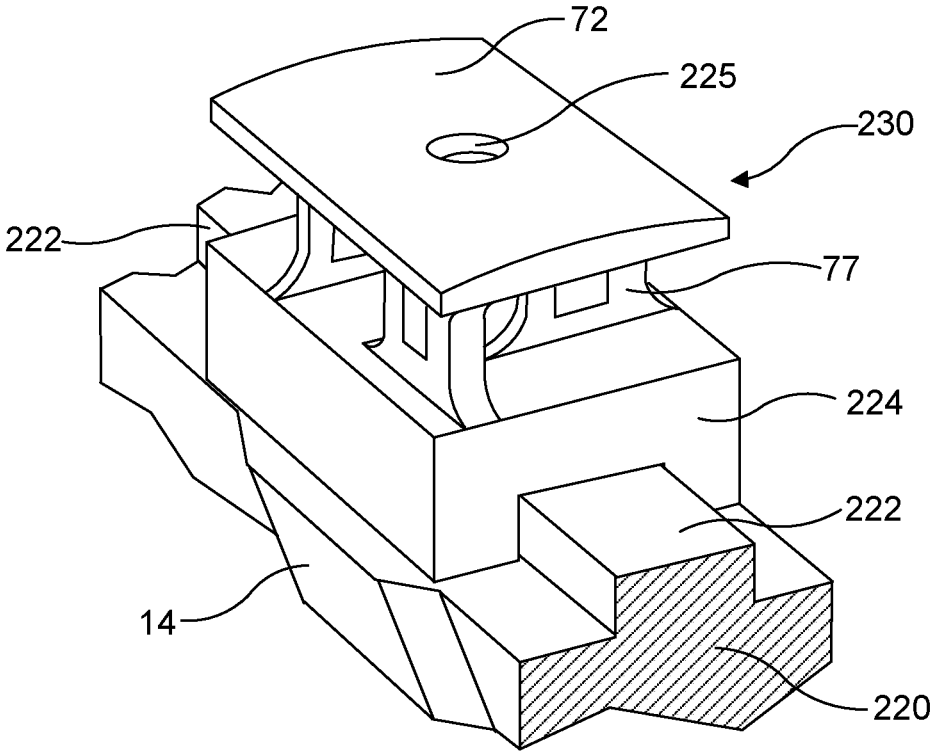
FIG. 25 is a perspective view of a sensor-containing unit used in a reamer, mill, or stabilizer, according to an embodiment.
Figure 26:
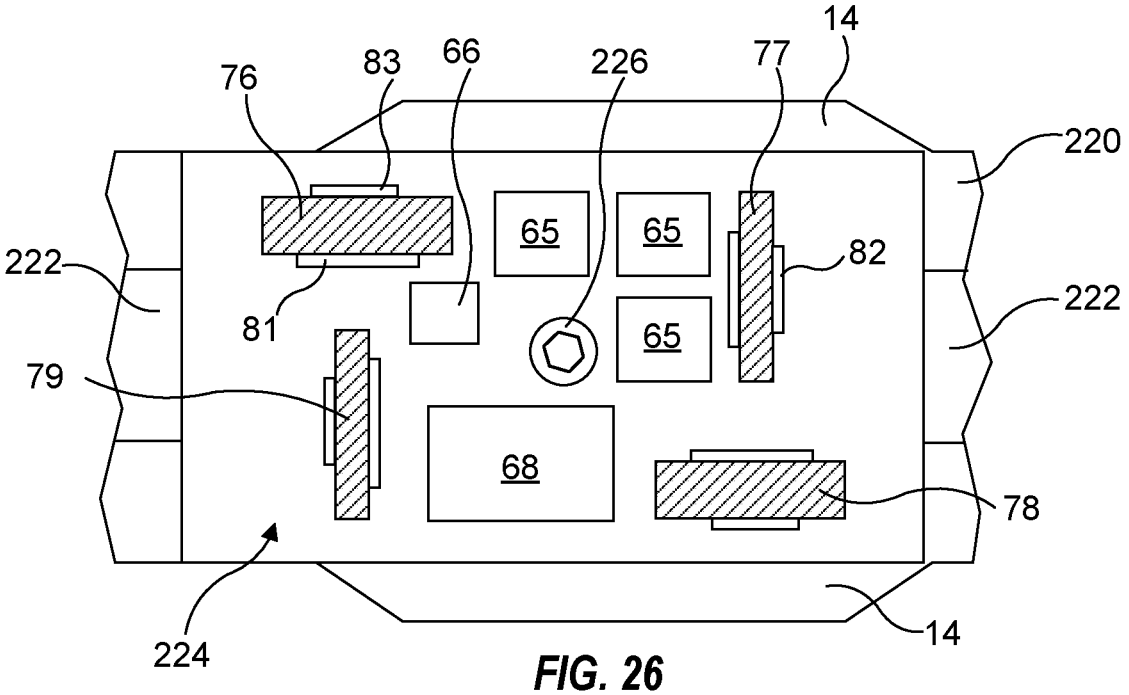
FIG. 26 is a sectional view, analogous to FIG. 11, showing parts of the sensor-containing unit of FIG. 25.

FIGS. 25 and 26 show a sensor-containing unit used to provide a gauge pad on a rotary tool which may be a reamer or hole opener equipped with blocks resembling the cutter block shown in FIG. 3. The block shown in FIG. 3 is fixed to a hole opener body, or may be radially expandable from the main body of a reamer under hydraulic pressure from fluid pumped down the drill string. The expansion can be guided by one or more splines 14 on the block which engage in grooves provided in the main body of the tool (or one or more grooves on the block which engage one or more splines on the body). A construction and an operating mechanism for a reamer of this kind includes the reamer described in U.S. Pat. Nos. 6,732,817 and 7,954,564, which are incorporated herein by this reference. As pointed out by the first of these, the structure and mechanism can be employed in an expandable stabilizer as well as in a reamer.

In the embodiment shown by FIGS. 25 and 26, a radially movable block can be constructed as an assembly of parts. In this embodiment, this includes an inner block 220, part of which is seen in FIG. 25. This inner block is provided with the splines 14 and has a projecting rib 222 extending along its outward facing surface. The outer part of the block can be formed by components shaped and arranged to mate with the rib 222, and which are bolted or otherwise fastened to the inner block 220. One of these components is optionally a sensor-containing unit 230 constructed similarly to the unit 70 of FIGS. 9-11. It has an exterior portion 72 connected to an attachment portion 224 by one or more connecting portions 76-79 fitted with strain gauges or other sensors. The exterior portion 72 includes or acts as a gauge pad to make sliding contact with a wellbore wall, and has a central hole 225 to provide access to a bolt 226, which acts as a mechanical fastener and secures the attachment portion 224 to the inner block 220.

Just as with the unit 70 shown in FIGS. 9 to 11, the spacing between the attachment portion 224 and the exterior portion 72 of a unit 230 provides a cavity in which sensors are accommodated. Accelerometers 65, a temperature sensor 66, an electronics package 68 to process outputs from the various sensors, or a combination thereof, are coupled to the attachment portion 224. The connecting portions 76-79 extend through the cavity and strain gauges 81-83 are attached to these connecting portions to observe distortion of corresponding connecting portions by forces on the exterior portion 72. Operation of these strain gauges 81-83 can be analogous to operation of strain gauges described herein with reference to FIGS. 12-16.

Structure as shown in FIGS. 25 and 26 may be part of a reamer, in which case other parts mounted astride the rib 222 are blocks with cutters fitted to them, to give an overall shape resembling that of the block shown in FIG. 3 (but with a sensor-containing unit 230 as gauge pad). The structure shown in FIGS. 25 and 26 can also be part of an expandable stabilizer, in which case there may be no outer blocks with cutters and additional gauge pads are mounted astride the rib 222. These additional pads may be solid parts with the same outline shape as the sensor-containing unit 230 shown in FIG. 25 or may be additional sensor-containing units. One possible arrangement for a stabilizer block has sensor-containing units at each end of inner block 220 and solid parts with the same outline positioned between them.

A further possibility is to use the structure of FIGS. 25 and 26 in an expandable tool intended to rotate within tubing placed within a borehole. In such case, the exterior portion 72 of a sensor-containing unit 230 will slide on the interior surface of the tubing. Other parts fitted astride the rib 222 may be blocks with attached cutters made of tungsten carbide for milling away unwanted restrictions in internal diameter (for instance at couplings between lengths of tubing) or for milling the inside wall of the tubing to enlarge it or even remove a section of tubing completely. This is illustrated by the example in FIG. 27, which shows an example of a tool to function as a casing or section mill inside tubing. The tool has a tubular main body accommodating cutter blocks which are expandable in the manner as shown and described for reamers in documents including U.S. Pat. Nos. 6,732,817 and 7,954,564.

Figure 27:
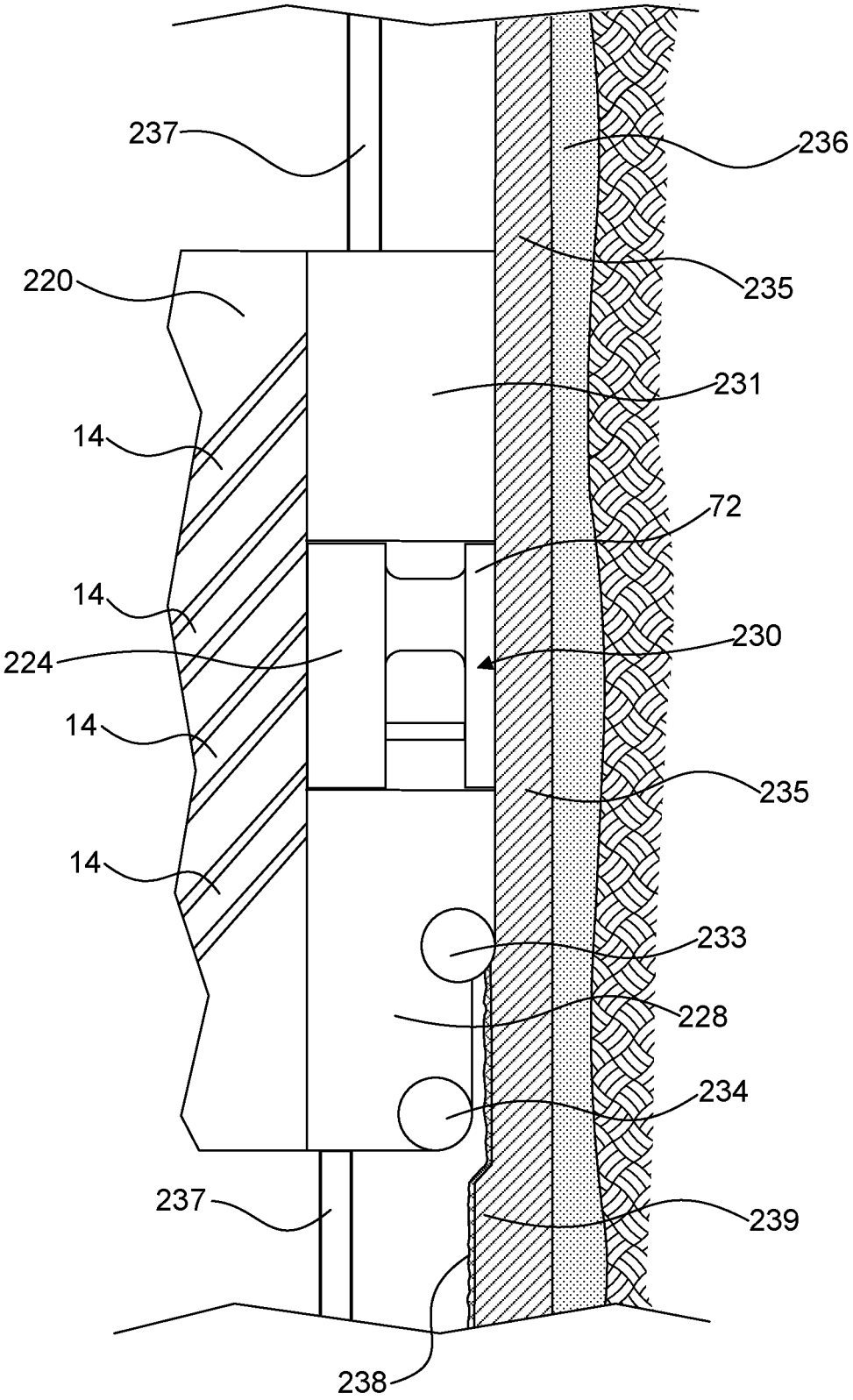
FIG. 27 is a side view of a milling blade used to remove material from tubing, according to an embodiment, and which incorporates a sensor-containing unit such as that shown in FIG. 25.

Cutter blocks having inner parts 220 and splines 14 as shown in FIG. 25, are distributed azimuthally around the tool body. FIG. 27 shows one of these blocks. The inner part 220 of the block has a rib 222 as shown in FIG. 25 (although this cannot be seen in FIG. 27). Fitted astride this rib 222 are at least three outer sections. These include at least a first cutter section 228 at the leading end of the block, a sensor-containing unit 230 of the type shown in FIGS. 25 and 26, and a further section 231 that may be a stabilizer or gauge pad, or may have cutters in some embodiments. The sensor-containing unit 230 incorporates sensors 65, 81-83, and an electronics package 68 just as in a unit 70 described herein.

The first cutter section 228 can be made of any suitable material (including steel or matrix material). As shown in FIG. 27, the first cutter section 206 can include one or more cutters (two cutters 233, 234 are shown) coupled thereto. Each of these cutters can include a cylinder of sintered tungsten carbide partially embedded in a cavity/pocket in the body, with an exposed planar or non-planar end face of the cylinder facing in the direction of rotation and providing a cutting surface. The exterior portion 72 of the sensor-containing unit 230 may be positioned at the same radial distance from the tool axis as the outer extremity of cutter 233. FIG. 27 shows the tool in use within tubing 235 which is secured in a wellbore with cement 236 between the tubing and the surrounding formation, although the cement 236 may be between the tubing and an outer tubing/casing. Because the block is extended through an aperture in the main body of the tool, an edge of the tool body is seen at 237.

The radially outer extremity of cutter 233 is at a distance from the tool axis which is slightly greater than the original inner radius of the tubing 235. As the tool rotates and advances axially, the cutter 233 removes corrosion 238 from the tubing interior and also removes a small thickness from the interior wall of the tubing. This creates a new and clean interior surface on which the exterior portion 72 of the sensor containing unit 230 slides as a gauge pad, thus positioning the tool on the axis of the tubing.

Projections inwardly into the tubing interior, as for instance seen at 239, may occur at couplings between lengths of tubing. When an inward projection 239 is encountered, some of the projection is removed by the cutter 234 and the remainder is removed by the following cutter 233. Overall, therefore, the tool is a rotary mill which functions to mill away any inward projections and interior corrosion from the internal surface of tubing and thereby create a uniform internal diameter within the tubing.

Figure 28:
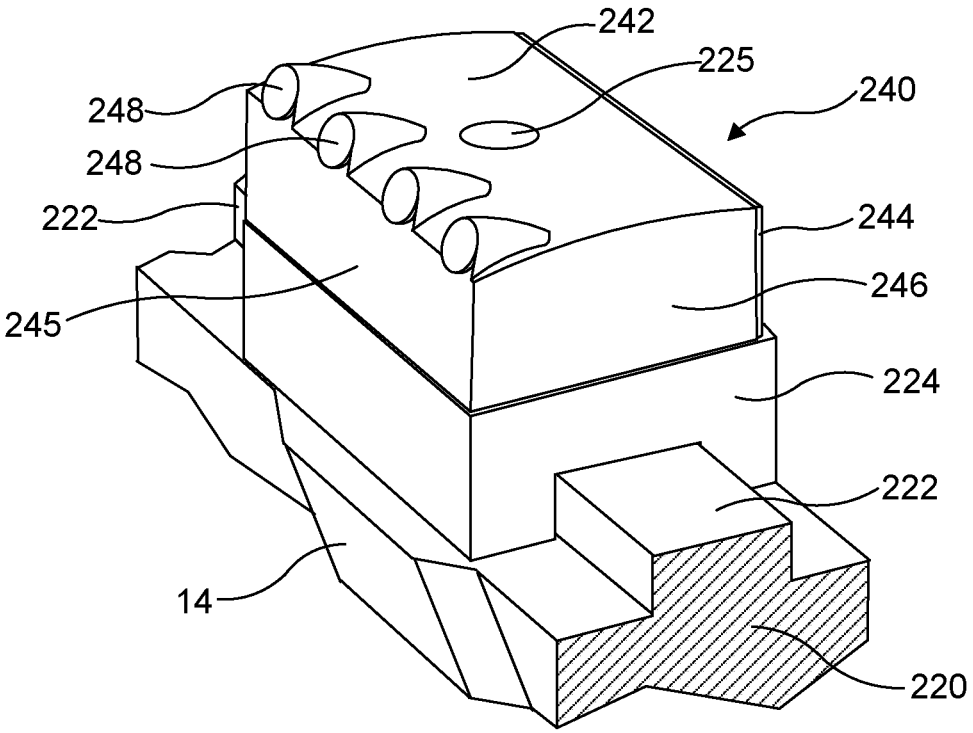
FIG. 28 is a perspective view of a sensor-containing unit used in a reamer cutter block, where the sensor-containing unit has cutters which remove material from the conduit wall.
Figure 29:
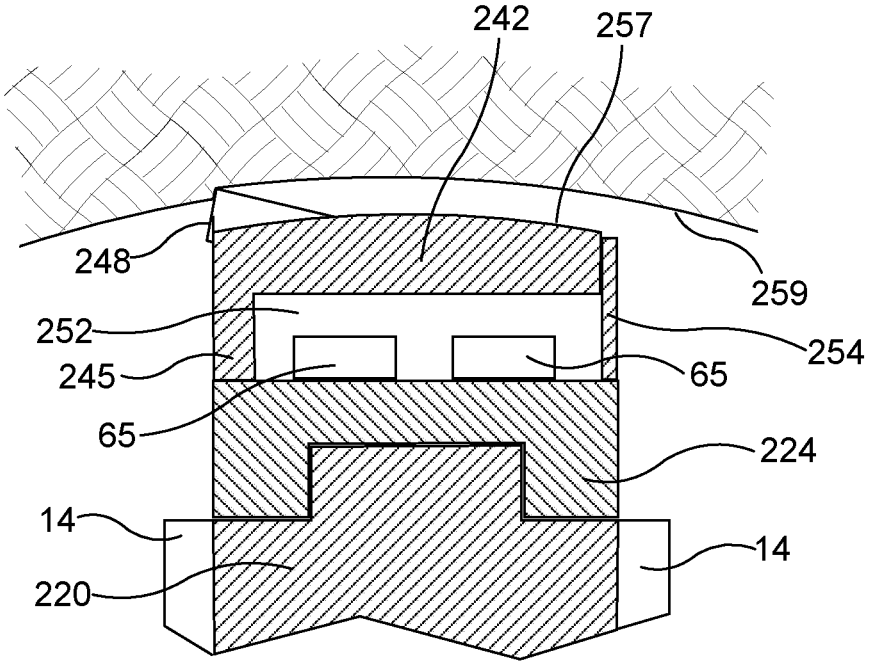
FIG. 29 is a section through the sensor-containing unit of FIG. 28, in contact with a borehole wall.

FIGS. 28 and 29 show another sensor-containing unit 240 that can be used in an expandable reamer. In part it is similar to the sensor-containing unit 40 shown in FIGS. 6-8 with an attachment portion 224 joined to an exterior portion 242 through a side wall 245 and end walls 246. The attachment portion 224 may be the same as shown in FIGS. 25 and 26, and fitted astride a rib 222 on an inner block 220, although the attachment portion 224 may also be integral with the inner block 220. In this embodiment, however, the exterior portion 242 is a block having pockets in which cutters 248 are secured so that they project from the surface 257 of the exterior portion 242. As shown by FIG. 29, the cutters 248 remove material from the wall 259 of the wellbore as the tool rotates and the outer surface 257 of the exterior portion following the cutters 248 may be spaced from the wellbore wall 259 as seen in FIG. 29. A cavity 252 accommodating sensors can be positioned between the attachment portion 224 and the exterior portion 242. In this embodiment, the cavity 252 accommodates accelerometers 65 connected to an electronics package (not seen in FIG. 29) elsewhere in the block or reamer.

As with the unit 40 shown in FIGS. 6 to 8, after the structure of the sensor-containing unit 240 has been made and equipped with accelerometers 65 and wiring for electrical connections, the side of the cavity 252 opposite the side wall 245 can be closed (e.g., with a plate 254 welded in place). The free space inside the cavity 252 is also optionally filled with electrically insulating material either before closing the cavity or after closing the cavity (e.g., by inserting the filler through a hole in the plate 254).

Figure 30:
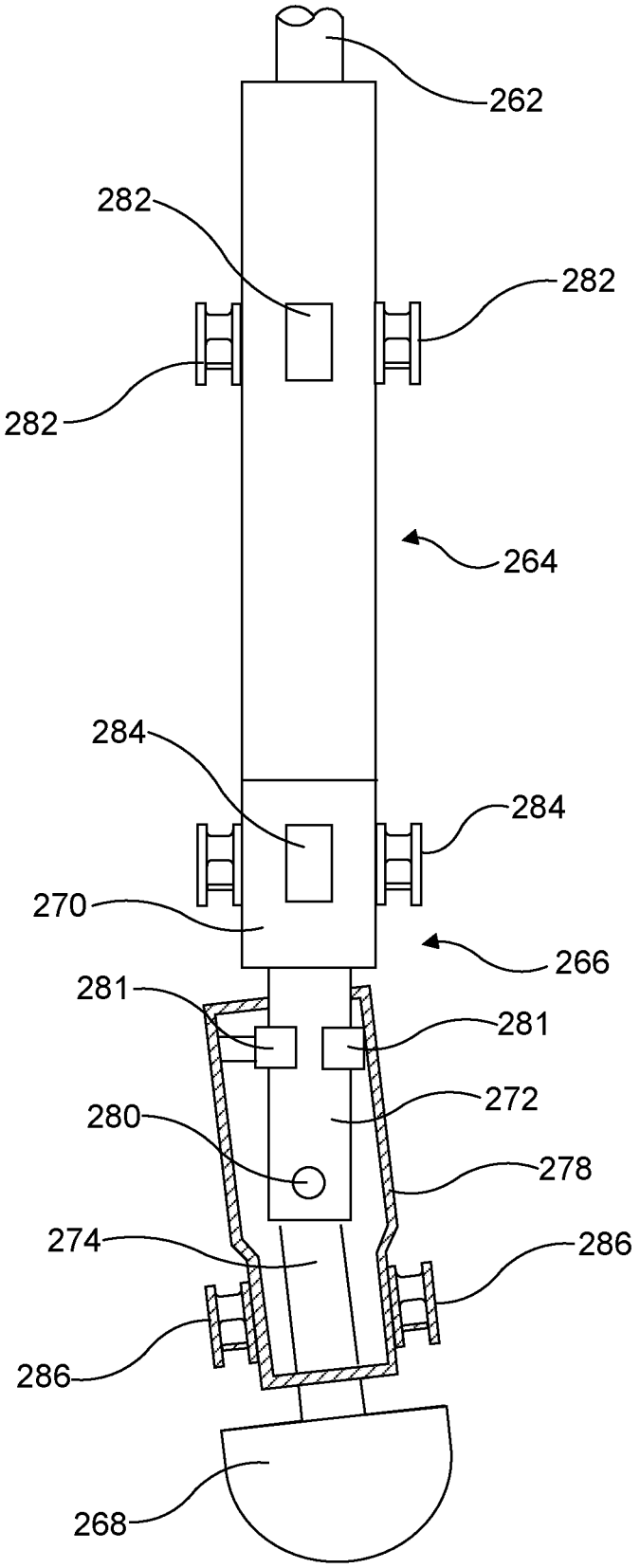
FIG. 30 is a schematic side view of a rotary steerable system for a drill bit, partially shown in section.

FIG. 30 shows a BHA containing a rotary steerable system for a drill bit. A drill collar 264 is attached to the downhole end of a drill string 262, a rotary steerable tool 266 is attached to the collar 264, and a drill bit 268 is attached the steerable tool 266.

The rotary steerable tool has a part 270 which is attached to the drill collar 264 and is continued by a part 272 of smaller diameter. A part 274 attached to the drill bit 268 is connected to the part 272 at a universal joint. A pivot of the universal joint is indicated schematically at 280. The part 274 includes a hollow section 278 which extends around the part 272. Actuators 281 can operate to incline the hollow section 278 together with the rest of part 274 and the drill bit 268 at an angle to the part 276, thus creating a bend in the bottom hole assembly, as shown. When it is required to change the direction of the wellbore being drilled, the actuators 281 are operated to keep the part 278 inclined towards the desired drilling direction as the drill string is rotated, thus steering the drill bit.

FIG. 30 shows this general arrangement schematically and does not provide constructional details of the mechanism for angling the part 278 of the steerable assembly relative to the part 276. Rotary steerable systems which operate by creating a bend in a bottom hole assembly and so putting the direction of the drill bit at an angle inclined relative to the axis of the drill string above it are described in U.S. Pat. Nos. 7,188,685, 6,364,034, 6,244,361, 6,158,529, 6,092,610, and 5,113,953 as well as U.S. Patent Application No. 2001/0052428, each of which is incorporated herein by this reference. Attention is therefore directed to these documents for disclosures of possible constructional arrangements.

The bottom hole assembly (BHA) shown in FIG. 30 is fitted with one or more sensor-containing units of the type described with reference to FIGS. 9 to 14. To aid explanation, these are shown without the shielding skirts 140, and are distributed both axially and azimuthally. Illustratively, four such units 282 are distributed azimuthally around the drill collar 264 with their attachment portions rigidly attached to the drill collar. Four more such sensor-containing units 284 are distributed azimuthally around the part 270 attached to the drill collar. A further four such units 286 are distributed around the hollow part 278 of the steerable tool, with corresponding attachment portions rigidly attached to this part 278 of the steerable tool.

The outer surfaces of the exterior portions of these sensor-containing units 282, 284, 286 are at the radius drilled by the bit 268 can therefore act as gauge or stabilizing pads in contact with the wall of the drilled wellbore. They can each measure accelerations in three orthogonal axes, and forces radially, axially, and circumferentially.

While the BHA of FIG. 30 has been described as having sensor-containing units around it at three axially spaced positions, it is also possible that the units 282, the units 284, or both could be replaced with gauge pads devoid of instrumentation. Similarly, drill bits described herein could include pads devoid of instrumentation or could include extensions of blades rather than the pads described herein. Thus, one or more blades of a bit (and less than all blades of the bit) may have pads and/or instrumentation. Similarly, one or more cutter or stabilizer blocks, milling knives, or the like may lack instrumentation or may not have a pad, but may instead be a blade, while other one or more cutter or stabilizer blocks, milling knives, or the like may have instrumentation and/or a gauge pad.

Figure 31:
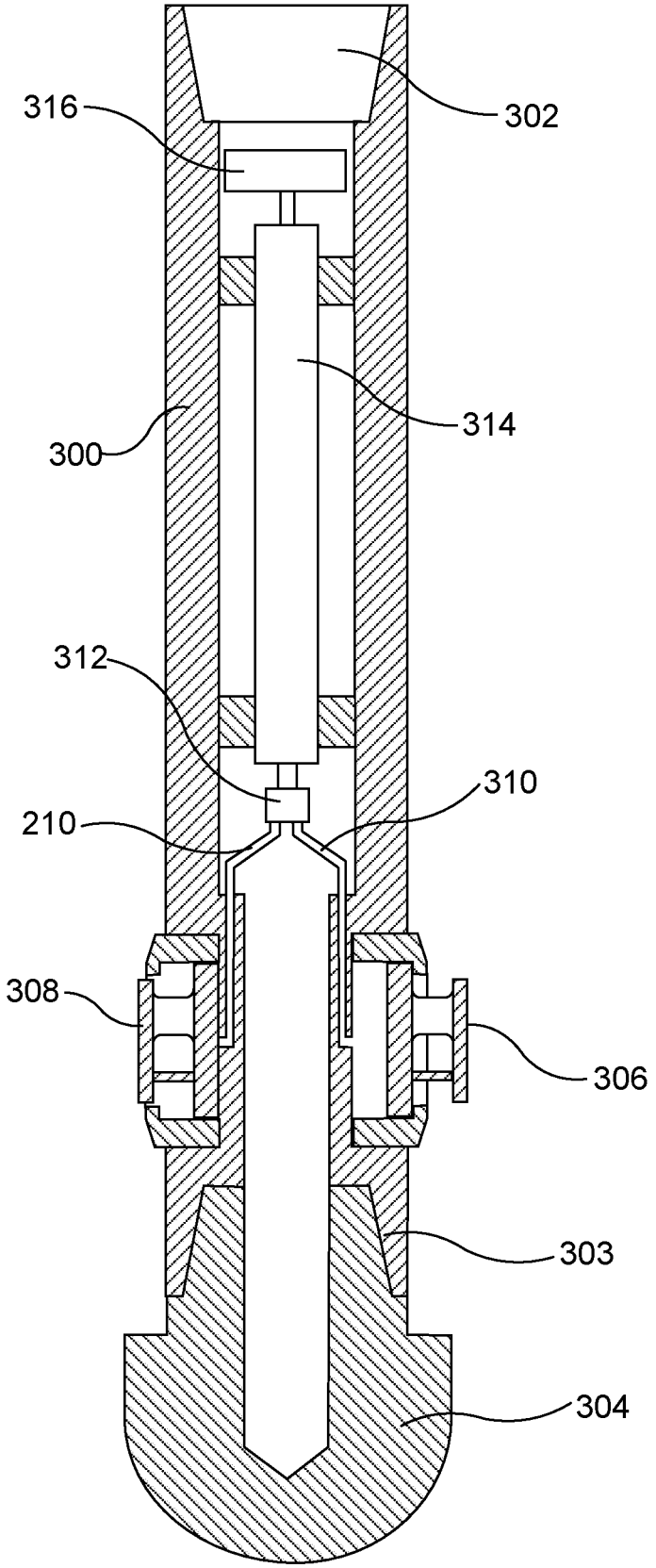
FIG. 31 is a schematic, cross-sectional view of a rotary steerable system, according to an example embodiment.
Figure 32:
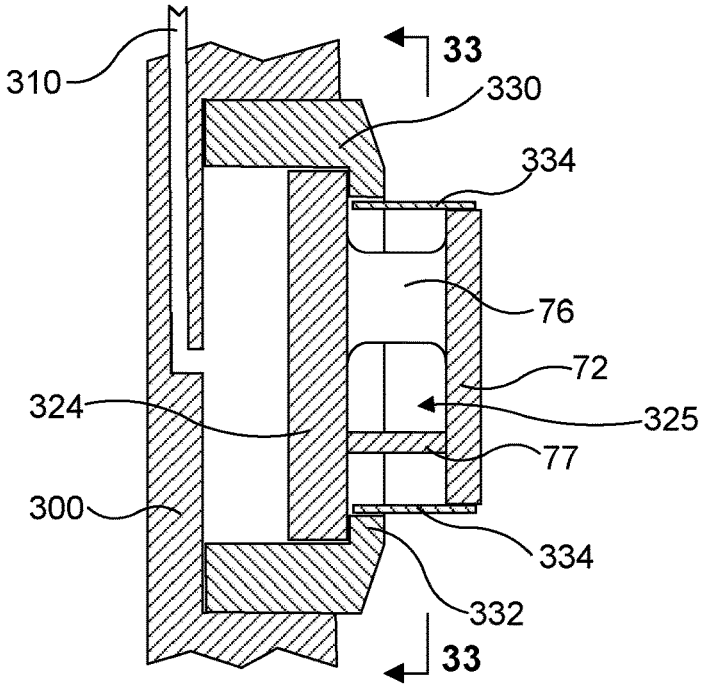
FIG. 32 is an enlarged view of a part of FIG. 31.
Figure 33:
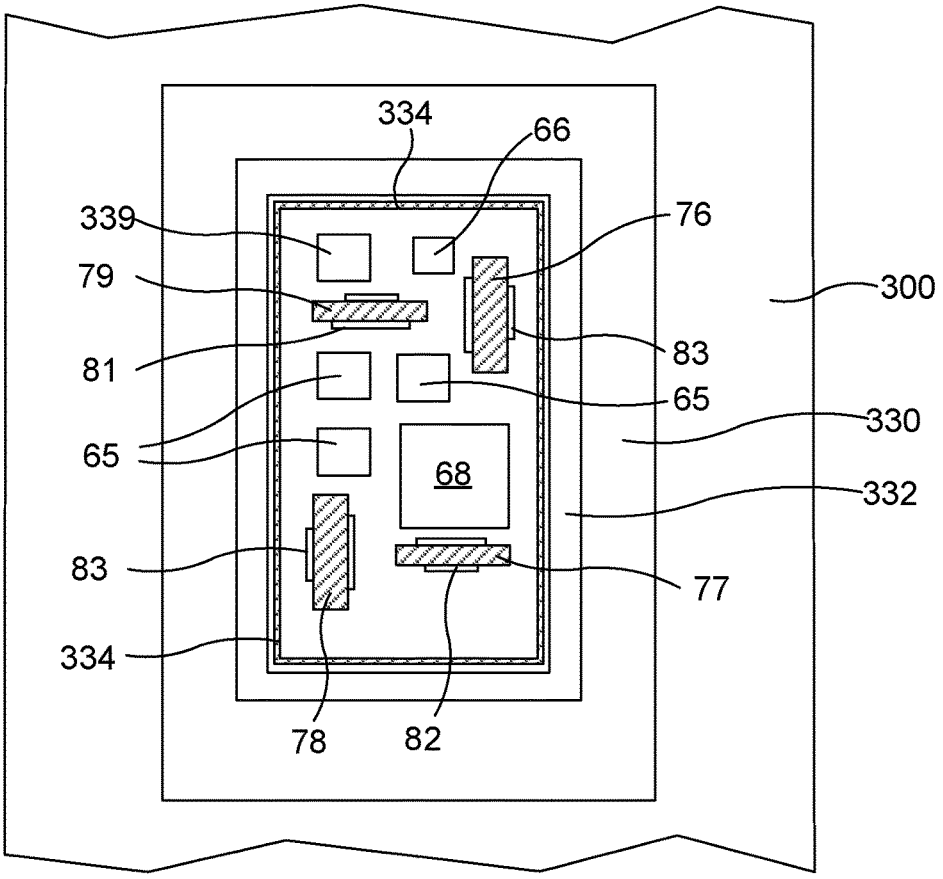
FIG. 33 is a view on line 33-33 of FIG. 32.

FIGS. 31 to 33 show a different type of rotary steerable system, again fitted with sensor-containing units of the type described with reference to FIGS. 9 to 14. The general construction of this rotary steerable system is similar to that shown in U.S. Pat. No. 8,672,056, the disclosure of which is incorporated herein by reference.

The rotary steerable tool has a main body 300 with a connector 302 at its uphole end for attaching to a drill string and a connector 303 at its downhole end to which a drill bit 304 is attached. Near its downhole end, the steerable tool has pads which can be extended by hydraulic pressure. For purpose of explanation, two diametrically opposite pads 306, 308 are shown, but three or even four pads distributed around the tool axis may be used. Fluid to extend the pads is supplied along hydraulic lines 310 from a valve 312 which allows the pads to be extended individually. It can be seen in FIG. 31 that pad 306 is extended but pad 308 is not. When it is required to change the direction in which the wellbore is being drilled, the valve 312 is operated to extend individual pads to push against one side of the wellbore wall as the assembly rotates. The effect is to steer the drill bit towards the opposite side of wellbore.

Rotary steerable systems which function by selectively extending pads to push against one side of the wellbore wall as the steerable tool and attached drill bit rotate described in U.S. Pat. Nos. 5,502,255, 5,706,905, 5,971,085, 6,089,332, and 8,672,056, which are each incorporated herein by this reference. In the tool shown here, the valve is operated by a unit 314 powered by turbine 316 in the path of the drilling fluid pumped to the drill bit. Details of a rotary valve 312 and operating arrangements for it are given in U.S. Pat. No. 8,672,056.

The steering pads of this embodiment are provided as sensor-containing units with construction resembling the elements 70 shown in FIGS. 9 to 11. FIGS. 32 and 33 show one of these sensor-containing units. Exterior portion 72 provides the pad to contact the wellbore wall and is coupled to a piston 324 by connecting portions 76-79. This piston 324 is movable within a cylinder defined by a housing 330 rigidly attached to the main body 300 of the steerable tool. A hydraulic line 310 leads into the cylinder defined by the housing 330 and the piston is retained in the housing by a lip 332. The connecting portions 326-329 are shown in section in FIG. 33, and extend between and are rigid with the exterior portion 72 and the piston 324.

Sensors are accommodated in the cavity 325 between the piston 324 and the exterior portion 72. These sensors can include accelerometers 65, a temperature sensor 66, an inclinometer 339, and strain gauges 81-83 whose positioning and function can be similar to that described with reference to FIGS. 12 to 14.

As previously described with reference to FIG. 24, after manufacture of the parts 72, 324, and 76-79 and the attachment of sensors, strain gauges and an electronics package 68, a skirt of material (e.g., sheet metal) is optionally welded or otherwise coupled to the edges of exterior portion 72 or the piston 324, and the volume within the skirt is filled with flexible, electrically insulating material (e.g., a polymer). The skirt is not shown in FIG. 31 but is shown in section in FIGS. 32 and 33.

When a sensor-containing unit is extended by hydraulic pressure so that its exterior portion 72 acts as a steering pad pressing on the borehole wall, its accelerometers 65 provide measurements of acceleration on up to three axes, and its strain gauges 81-83 provide measurements of axial, circumferential, and radial forces in the same manner as described with reference to FIGS. 12 to 14.

It will be appreciated that radial force on the exterior portion 72 will be transmitted through the connecting portions 76-79 and the piston 324 to the hydraulic fluid behind the piston 324. This hydraulic fluid will have some compliance and consequently will also undergo compressive strain. However, force is transmitted through the exterior portion 72, the connecting portions, the piston 324 and the hydraulic fluid in series. Consequently, they are all exposed to the force and so the connecting portions will undergo compressive strain which can be measured by the strain gauges 81-83 even though the force is transmitted onwards to the hydraulic fluid.

Concepts disclosed herein are not limited to any specific category of rotary tool and have been exemplified for a variety of rotary tools intended for operating within a conduit which may be a borehole or may be tubing within the borehole. Data measured by sensors may be transmitted to the surface using known technologies for transmission of data from a bottom hole assembly to the surface, may be recorded downhole for later analysis, or may be processed by downhole electronics, and an alarm communication sent the surface if forces exceed expected magnitudes.

The example embodiments described in detail above can be modified and varied within the scope of the concepts which they exemplify. Features referred to above or shown in individual embodiments above may be used separately or together in any combination so far as this is possible. More specifically, sensor-containing units 40 shown in FIGS. 6 to 8, units 70 shown in FIGS. 9 to 14 and units using the carriers 120 to eliminate bending strain may each be used in any of the rotary tools described with reference to FIGS. 25 to 33 of the drawings. The drill bit shown in the drawings is a fixed cutter drill bit, but the sensor arrangements described herein could also be employed on a different type of drill bit such as a roller cone drill bit, an impregnated bit, a percussion hammer bit, or a coring bit. Accordingly, all such modifications are intended to be included within the scope of this disclosure as defined in the following claims.

The invention claimed is:

1. A rotary tool for operation within an underground conduit, comprising:

a tool body rotatable around a longitudinal axis of the tool body; and a sensor housing, including:

an attachment portion connectable to the tool body;

an exterior portion opposite the attachment portion, the exterior portion and the attachment portion forming a cavity therebetween, wherein, when the attachment portion is connected to the tool body, the exterior portion being extended radially away from the tool body; and one or more connecting portions joining the exterior portion to the attachment portion and extending radially between the attachment portion and the exterior portion; and at least one carrier that includes a plurality of sensors located in the cavity between the exterior portion and the attachment portion, the plurality of sensors including at least:

two sensors attached to a first surface of the one or more connecting portion; and two sensors attached to a second surface of the one or more connecting portions, the first and second surfaces being oriented to face different directions, and wherein the two sensors attached to the first surface are electrically coupled to the two sensors attached to the second surface and are oriented in a manner causing the plurality of sensors on the carrier to collectively be sensitive to exactly one of circumferential force, axial force, or radial force.

2. The rotary tool of claim 1, wherein the exterior portion covers the carrier.

3. The rotary tool of claim 1, the one or more connecting portions having a total cross-sectional area that is less than an area of an outer surface of the exterior portion which faces radially outwards towards the wall of the conduit.

4. The rotary tool of claim 1, the one or more connecting portions being more flexible than the at least one exterior portion and the tool body.

5. The rotary tool of claim 1, wherein the exterior portion and the one or more connecting portions are part of a unit that also includes a side wall extending between the exterior portion and the attachment portion to partially enclose the cavity.

6. The rotary tool of claim 5, further comprising:

a shield enclosing the cavity and extending across more than half a distance between the exterior portion and the attachment portion.

7. The rotary tool of claim 1, wherein the carrier is a first carrier, and the rotary tool further comprises:

a second carrier including two sensors attached to a third surface of the one or more connecting portions and two sensors attached to a fourth surface of the one or more connecting portions, the third and fourth surfaces being perpendicular to the first and second surfaces, wherein the two sensors of the second carrier are collectively sensitive to exactly one of circumferential force, axial force, or radial force, but with a sensitivity different than the plurality of sensors of the first carrier.

8. The rotary tool of claim 1, wherein the two sensors attached to the first surface and the two sensors attached to the second surface are selected from a group consisting of an accelerometer, a magnetometer, an inclinometer, a temperature sensor, and a strain gauge.

9. The rotary tool of claim 1, further comprising:

electronic circuitry connected to the carrier and located in the cavity.

10. The rotary tool of claim 9, the electronic circuitry including a transmission unit configured to transmit data from the carrier to a tool located above the rotary tool in a BHA.

11. The rotary tool of claim 1, further comprising:

an electrically insulating material filling the cavity.

12. The rotary tool of claim 1, wherein the exterior portion and the carrier sensor are removably attached to the tool body.

13. A method of obtaining data by operating a rotary tool, comprising:

connecting an attachment portion of a sensor housing to a tool body, the sensor housing including at least one sensor attached to one or more connecting portions and located between the attachment portion and an exterior portion, the exterior portion covering the at least one sensor, and the at least one sensor including:

first and second strain gauges attached to a first surface of the one or more connecting portions; and third and fourth strain gauges attached to a second surface of a second surface of the one or more connecting portions, the first and second surfaces facing in opposing directions;

positioning the rotary tool within a wellbore; and observing or recording data from the at least one sensor while operating the rotary tool within the wellbore, wherein the data is produced by the first, second, third, and fourth strain gauges which are collectively sensitive to exactly one of circumferential, axial, or radial force.

14. The method of claim 13, wherein observing or recording data includes recording data to an electronics unit in the cavity.

15. The method of claim 13, wherein observing or recording data includes recording data to a device separate from the rotary tool and positioned in a BHA in the wellbore.

16. The method of claim 13, wherein observing or recording data includes transmitting raw or processed data from the at least one sensor to a surface location.

17. The method of claim 13, wherein the rotary tool is a drill bit, an underreamer, a section mill, a stabilizer, or a rotary steerable tool.

18. The rotary tool of claim 1, wherein the exterior portion extends across an entirety of a length of the attachment portion.

19. The rotary tool of claim 1, wherein the exterior portion, the attachment portion, and the one or more connecting portions are made as a one-piece article.

20. The rotary tool of claim 1, wherein the two sensors attached to the first surface form a chevron strain gauge.

* * * * *